US007315815B1

(12) United States Patent
Gersho et al.

(10) Patent No.: US 7,315,815 B1
(45) Date of Patent: Jan. 1, 2008

(54) LPC-HARMONIC VOCODER WITH SUPERFRAME STRUCTURE

(75) Inventors: Allen Gersho, Goleta, CA (US); Vladimir Cuperman, Goleta, CA (US); Tian Wang, Goleta, CA (US); Kazuhito Koishida, Goleta, CA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/401,068

(22) Filed: Sep. 22, 1999

(51) Int. Cl.
*G10L 19/12* (2006.01)

(52) U.S. Cl. ..... 704/223

(58) Field of Classification Search ..... 704/219–223, 704/230

See application file for complete search history.

(56) References Cited

U.S. PATENT DOCUMENTS 4,969,192 A 11/1990 Chen et al.
5,255,339 A * 10/1993 Fette et al. ..... 704/200
5,394,473 A 2/1995 Davidson
5,664,051 A * 9/1997 Hardwick et al. ..... 704/206
5,668,925 A 9/1997 Rothweiler et al.
5,699,485 A 12/1997 Shoham
5,717,823 A 2/1998 Kleijn
5,734,789 A 3/1998 Swaminathan et al.
5,737,484 A 4/1998 Ozawa
5,751,903 A 5/1998 Swaminathan et al.
5,778,335 A 7/1998 Ubale et al.
5,819,212 A 10/1998 Matsumoto et al.
5,835,495 A 11/1998 Ferriere
5,870,412 A 2/1999 Schuster et al.
5,873,060 A 2/1999 Ozawa
5,890,108 A 3/1999 Yeldener
6,009,122 A 12/1999 Chow
6,029,126 A 2/2000 Malvar
6,041,345 A 3/2000 Levi et al.
6,108,626 A 8/2000 Cellario et al.
6,128,349 A 10/2000 Chow
6,134,518 A 10/2000 Cohen et al.
6,199,037 B1 * 3/2001 Hardwick ..... 704/208

(Continued)

FOREIGN PATENT DOCUMENTS

CA 1336454 7/1995

(Continued)

OTHER PUBLICATIONS

Andersen et al., "ILBC—a Linear Predictive Coder with Robustness to Packet Losses," Proc. IEEE Workshop on Speech Coding, 2002, pp. 23-25 (2002).

(Continued)

*Primary Examiner*—Angela Armstrong
(74) *Attorney, Agent, or Firm*—Klarquist Sparkman, LLP

(57) ABSTRACT

An enhanced low-bit rate parametric voice coder that groups a number of frames from an underlying frame-based vocoder, such as MELP, into a superframe structure. Parameters are extracted from the group of underlying frames and quantized into the superframe which allows the bit rate of the underlying coding to be reduced without increasing the distortion. The speech data coded in the superframe structure can then be directly synthesized to speech or may be transcoded to a format so that an underlying frame-based vocoder performs the synthesis. The superframe structure includes additional error detection and correction data to reduce the distortion caused by the communication of bit errors.

20 Claims, 5 Drawing Sheets

U.S. PATENT DOCUMENTS

| | | | | |
|---|---|---|---|---|
| 6,202,045 | B1 * | 3/2001 | Ojala et al. | 704/203 |
| 6,226,606 | B1 | 5/2001 | Acero | |
| 6,240,387 | B1 | 5/2001 | DeJaco | |
| 6,263,312 | B1 | 7/2001 | Kolesnik et al. | |
| 6,289,297 | B1 | 9/2001 | Bahl | |
| 6,292,834 | B1 | 9/2001 | Ravi et al. | |
| 6,310,915 | B1 | 10/2001 | Wells et al. | |
| 6,311,154 | B1 | 10/2001 | Gersho et al. | |
| 6,317,714 | B1 | 11/2001 | Del Castillo et al. | |
| 6,351,730 | B2 | 2/2002 | Chen | |
| 6,385,573 | B1 | 5/2002 | Gao et al. | |
| 6,392,705 | B1 | 5/2002 | Chaddha | |
| 6,408,033 | B1 | 6/2002 | Chow et al. | |
| 6,438,136 | B1 | 8/2002 | Bahl | |
| 6,460,153 | B1 | 10/2002 | Chou et al. | |
| 6,493,665 | B1 | 12/2002 | Su et al. | |
| 6,499,060 | B1 | 12/2002 | Wang et al. | |
| 6,505,152 | B1 | 1/2003 | Acero | |
| 6,621,935 | B1 | 9/2003 | Xin et al. | |
| 6,647,063 | B1 | 11/2003 | Oikawa | |
| 6,647,366 | B2 | 11/2003 | Wang et al. | |
| 6,658,383 | B2 | 12/2003 | Koishida et al. | |
| 6,693,964 | B1 | 2/2004 | Zhang et al. | |
| 6,732,070 | B1 | 5/2004 | Rotola-Pukkila et al. | |
| 6,757,654 | B1 | 6/2004 | Westerlund et al. | |
| 6,823,303 | B1 | 11/2004 | Su et al. | |
| 6,952,668 | B1 | 10/2005 | Kapilow | |
| 7,003,448 | B1 | 2/2006 | Lauber et al. | |
| 7,065,338 | B2 | 6/2006 | Mano et al. | |
| 7,117,156 | B1 | 10/2006 | Kapilow | |
| 2001/0023395 | A1 | 9/2001 | Su et al. | |
| 2002/0097807 | A1 | 7/2002 | Gerrits | |
| 2003/0004718 | A1 | 1/2003 | Rao | |
| 2003/0009326 | A1 | 1/2003 | Wang et al. | |
| 2003/0016630 | A1 | 1/2003 | Vega-Garcia et al. | |
| 2003/0101050 | A1 | 5/2003 | Khalil et al. | |
| 2003/0115050 | A1 | 6/2003 | Chen et al. | |
| 2003/0115051 | A1 | 6/2003 | Chen et al. | |
| 2003/0135631 | A1 | 7/2003 | Li et al. | |
| 2005/0228651 | A1 | 10/2005 | Wang et al. | |
| 2006/0271354 | A1 | 11/2006 | Sun et al. | |
| 2006/0271355 | A1 | 11/2006 | Wang et al. | |
| 2006/0271373 | A1 | 11/2006 | Khalil et al. | |

FOREIGN PATENT DOCUMENTS

| | | |
|---|---|---|
| EP | 0 503 684 | 9/1992 |
| FR | 2 784 218 | 4/2000 |
| FR | 2 784 218 A1 | 4/2000 |
| GB | 2 324 689 | 10/1998 |
| GB | 2 324 689 A | 10/1998 |
| JP | 1013200 | 1/1989 |
| WO | WO 98 27543 | 6/1998 |
| WO | WO 00 11655 | 3/2002 |

OTHER PUBLICATIONS

B. Bessette, R. Salami, C. Laflamme and R. Lefebvre, "A Wideband Speech and Audio Codec at 16/24/32 kbit/s using Hybrid ACELP/TCX Techniques," in Proc. IEEE Workshop on Speech Coding, pp. 7-9, 1999.

Chen et al., "Adaptive Postfiltering for Quality Enhancement of Coded Speech," IEEE Transactions on Speech and Audio Processing, vol. 3, No. 1, pp. 59-71 (1995).

J-H. Chen and D. Wang, "Transform Predictive Coding of Wideband Speech Signals," in Proc. International Conference on Acoustic, Speech, Signal Processing, pp. 275-278, 1996.

Combescure, P., et al., "A16, 24, 32 kbit/s Wideband Speech Codec Based on ATCELP," *In Proceedings of IEEE International Conference on Acoustics, Speech, and Signal Processing*, vol. 1, pp. 5-8 (Mar. 1999).

El Maleh, K., et al., "Speech/Music Discrimination for Multimedia Applications," *In Proceedings of IEEE International Conference on Acoustics, Speech, and Signal Processing*, vol. 4, pp. 2445-2448, (Jun. 2000).

Ellis, D., et al. "Speech/Music Discrimination Based on Posterior Probability Features," *In Proceedings of Eurospeech*, 4 pages, Budapest (1999).

Erdmann et al., "An Adaptive Multi Rate Wideband Speech Codec with Adaptive Gain Re-quantization," Proc. IEEE Workshop on Speech Coding, 2000, pp. 145-147 (2000).

Erhart et al., "A speech packet recovery technique using a model based tree search interpolator," Proc. 1993 IEEE Workshop on Speech Coding for Telecommunications, pp. 77-78 (1993).

Feldbauer et al., "Speech Coding Using Motion Picture Compression Techniques," Proc. IEEE Workshop on Speech Coding, 2002, pp. 47-49 (2002).

Fingscheidt et al., "Joint Speech Codec Parameter and Channel Decoding of Parameter Individual Block Codes (PIBC)," Proc. 1999 IEEE Workshop on Speech Coding, pp. 75-77 (1999).

Fout, "Media Support in the Microsoft Windows Real-Time Communications Client," 6 pp. [Downloaded from the World Wide Web on Feb. 26, 2004.].

Gerson et al., "Vector Sum Excited Linear Prediction (VSELP) Speech Coding at 8 KBPS," CH2847-2/90/0000-0461 IEEE, pp. 461-464 (1990).

Heinen et al., "Robust Speech Transmission Over Noisy Channels Employing Non-linear Block Codes," Proc. 1999 IEEE Workshop on Speech Coding, pp. 72-74 (1999).

Houtgast, T., et al., "The Modulation Transfer Function in Room Acoustics As A Predictor or Speech Intelligibility," *Acustica*, vol. 23, pp. 66-73 (1973).

Ikeda et al., "Error-Protected TwinVQ Audio Coding at Less Than 64 kbit/s/ch," Proc. 1995 IEEE Workshop on Speech Coding for Telecommunications, pp. 33-34 (1995).

ITU-T, G.722.1 (Sep. 1999), Series G: Transmission Systems and Media, Digital Systems and Networks, Coding at 24 and 32 kbit/s for hands-free operation in systems with low frame loss.

ITU-T, "ITU-T Recommendation G.722, General Aspects of Digital Transmission Systems—Terminal Equipments 7 kHz Audio—Coding within 64 kbit/s," 75 pp. (1988).

ITU-T, "ITU-T Recommendation G.722.1, Series G: Transmission Systems and Media, Digital Systems and Networks. Digital terminal equipments—Coding of analogue signals by methods other than PCM—Coding at 24 and 32 kbit/s for hands-free operation in systems with low frame loss," 26 pp. (1999).

ITU-T, "ITU-T Recommendation G.722.1—Corrigendum 1, Series G: Transmission Systems and Media, Digital Systems and Networks. Digtial terminal equipments—Coding of analogue signals by methods other than PCM—Coding at 24 and 32 kbit/s for hands-free operation in systems with low frame loss," 9 pp. (2000).

ITU-T, "ITU-T Recommendation G.722.1 Annex A, Series G: Transmission Systems and Media, Digital Systems and Networks. Digtial terminal equipments—Coding of analogue signals by methods other than PCM—Coding at 24 and 32 kbit/s for hands-free operation in systems with low frame loss, Annex A: Packet format, capability identifiers and capability parameters" 9 pp. (2000).

ITU-T, "ITU-T Recommendation G.722.1 Annex B, Series G: Transmission Systems and Media, Digital Systems and Networks. Digital terminal equipments—Coding of analogue signals by methods other than PCM—Coding at 24 and 32 kbit/s for hands-free operation in systems with low frame loss, Annex B: Floating-point implementation for G.722.1" 9 pp. (2000).

ITU-T, "ITU-T Recommendation G.722.2, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB)," 71 pp. (2003).

ITU-T, "ITU-T Recommendation G.722.2 Erratum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB)," 1 pp. (2004).

ITU-T, "ITU-T Recommendation G.722.2 Annex A, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex A: Comfort noise aspects," 14 pp. (2002).
ITU-T, "ITU-T Recommendation G.722.2 Annex B, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex B: Source Controlled Rate Operation," 13 pp. (2002).
ITU-T, "ITU-T Recommendation G.722.2 Annex B Erratum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex B: Source Controlled Rate Operation," 1 p. (2003).
ITU-T, "ITU-T Recommendation G.722.2 Annex C Erratum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex C: Fixed-point C-code," 2 pp. (2004).
ITU-T, "ITU-T Recommendation G.722.2 Annex D, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex D: Digital test sequences," 13 pp. (2003).
ITU-T, "ITU-T Recommendation G.722.2 Annex E, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex E: Frame Structure," 27 pp. (2002).
ITU-T, "ITU-T Recommendation G.722.2 Annex E Corrigendum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex E: Frame Structure," 1 p. (2003).
ITU-T, "ITU-T Recommendation G.722.2 Annex F, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex F: AMR-WB using in H.245," 10 pp. (2002).
ITU-T, "ITU-T Recommendation G.723.1, General Aspects of Digital Transmission Systems, Dual Rate Speech Coder for Multimedia Communications Transmitting at 5.3 and 6.3 kbits/s," 31 pp. (1996).
ITU-T, "ITU-T Recommendation G.723.1 Annex A, Series G: Transmission Systems and Media, Digital transmissions systems—Terminal Equipments—Coding of analogue signals by methods other than PCM, Dual Rate Speech Coder for Multimedia Communications Transmitting at 5.3 and 6.3 kbit/s, Annex A: Silence compression scheme," 21 pp. (1996).
ITU-T, "ITU-T Recommendation G.723.1 Annex B, Series G: Transmission Systems and Media, Digital transmissions systems—Terminal Equipments—Coding of analogue signals by methods other than PCM, Dual Rate Speech Coder for Multimedia Communications Transmitting at 5.3 and 6.3 kbit/s, Annex B: Alternative specification based on floating point arithmetic," 8 pp. (1996).
ITU-T, "ITU-T Recommendation G.723.1 Annex C, Series G: Transmission Systems and Media, Digital transmissions systems—Terminal Equipments—Coding of analogue signals by methods other than PCM, Dual Rate Speech Coder for Multimedia Communications Transmitting at 5.3 and 6.3 kbit/s, Annex C: Scalable channel coding scheme for wireless applications," 23 pp. (1996).
ITU-T, "ITU-T Recommendation G.728, General Aspects of Digital Transmission Systems; Terminal Equipment Coding of Speech at 16 kbit/s Using Low-Delay Code Excited Linear Prediction," 65 pp. (1992).
ITU-T, "ITU-T Recommendation G.728 Annex G, General Aspects of Digital Transmission Systems; Terminal Equipment Coding of Speech at 16 kbit/s Using Low-Delay Code Excited Linear Prediction, Annex G: 16 kbit/s Fixed Point Specification," 67 pp. (1994).
ITU-T, "ITU-T Recommendation G.728 Annex G Corrigendum 1, Series G: Transmission Systems and Media, Digital Systems and Networks, Digital Transmission Systems; Terminal Equipment Coding of Analogue Signals by methods other than PCM, Coding of Speech at 16 kbit/s Using Low-Delay Code Excited Linear Prediction, Annex G: 26 kbit/s Fixed Point Specification—Corrigendum 1," 11 pp. (2000).
ITU-T, "ITU-T Recommendation G.728 Annex H, Series G: Transmission Systems and Media, Digital Systems and Networks, Digital Transmission Systems; Terminal Equipment Coding of Analogue Signals by methods other than PCM, Coding of speech at 16 kbits/s Using Low-Delay Code Excited Linear Prediction, Annex H: Variable bit rate LD-CELP operation mainly for DCME at rates less than 16 kbit/s," 19 pp. (1999).
ITU-T, "ITU-T Recommendation G.728 Annex I, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex I: Frame or packet loss concealment for the LD-CELP decoder," 25 pp. (1999).
ITU-T, "ITU-T Recommendation G.728 Annex J, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex J: Variable bit-rate operation of LD-CELP mainly for voiceband-data applications in DCME," 40 pp. (1999).
ITU-T, "ITU-T Recommendation G.729, Coding of Speech at 8 kbit/s Using Conjugate-Structure Algebraic-Code-Excited Linear-Prediction (CS-ACELP)," 39 pp. (1996).
Johansson et al., "Bandwidth Efficient AMR Operation for VoIP," Proc. IEEE Workshop on Speech Coding, 2002, pp. 150-152 (2002).
Kabal et al., "Adaptive Postfiltering for Enahancement of Noisy Speech in the Frequency Domain," CH 3006-4/91/0000-0312 IEEE, pp. 312-315.
Koishida et al., "Enhancing MPEG-4 CELP by Jointly Optimized Inter/Intra-frame LSP Predictors," Proc. IEEE Worshop on Speech Coding, 2000, pp. 90-92 (2000).
Kroon et al., "Quantization Procedures for the Excitation of Celp Coders," CH2396-0/87/0000-1649 IEEE, pp. 1649-1652 (1987).
Kubin et al., "Multiple-Description Coding (MDC) of Speech with an Invertible Auditory Model," Proc. 1999 IEEE Workshop on Speech Coding, pp. 81-83 (1999).
Lakaniemi et al., "AMR and AMR-WB RTP Payload Usage in Packet Switched Conversational Multimedia Services," Proc. IEEE Workshop on Speech Coding, 2002, pp. 147-149 (2002).
Lefebvre, et al., "High quality coding of wideband audio signals using transform coded excitation (TCS)," Apr. 1994, 1994 IEEE International Conference on Acoustics, Speech, and Signal Processing, vol. 1, pp. I/193-I/196.
Lefebvre et al., "Spectral Amplitude Warping (SAW) for Noise Spectrum Shaping in Audio Coding," IEEE, pp. 335-338 (1997).
Liang, et al., "Adaptive Playout Scheduling and Loss Concealment for Voice Communication Over IP Networks," IEEE Transactions on Multimedia, vol. 5, No. 4, pp. 532-543 (2003).
Makinen et al., "The Effect of Source Based Rate Adaptation Extension in AMR-WB Speech Codec," Proc. IEEE Workshop on Speech Coding, 2002, pp. 153-155 (2002).
McAulay, "Sine-Wave Amplitude Coding at Low Data Rates, Advances in Speech Coding," *Kluwer Academic Pub*., pp. 203-214, 1991.
Microsoft Corporation, "Using the Windows Media Audio 9 Voice Codec," 4 pp. [Downloaded from the World Wide Web on Feb. 26, 2004.].

Morinaga et al., "The Forward-Backward Recovery Sub-Codec (FB-RSC) Method: A Robust Form of Packet-Loss Concealment for Use in Broadband IP Networks," Proc. IEEE Workshop on Speech Coding, 2002, pp. 62-64 (2002).
Mustapha et al., "An Adaptive Post-Filtering Technique Based on the Modified Yule-Walker Filter," ICASSP-1999, 4 pp. (1999).
Nomura et al., "Voice Over IP Systems with Speech Bitrate Adaptation Based on MPEG-4 Wideband CELP," Proc. 1999 IEEE Workshop on Speech Coding, pp. 132-134 (1999).
Ozawa et al., "Study and Subjective Evaluation on MPEG-4 Narrowband CELP Coding Under Mobile Communication Conditions," Proc. 1999 IEEE Workshop on Speech Coding, pp. 129-131 (1999).
Rahikka et al., "Error Coding Strategies for MELP Vocoder in Wireless and ATM Environments," IEEE Seminar on Speech Coding for Algorithms for Radio Channels, pp. 8/1-8/3 (2000).
Rahikka et al., "Optimized Error Correction of MELP Speech Parameters Via Maximum A Posteriori (MAP) Techniques," Proc. 1999 IEEE Workshop on Speech Coding, pp. 78-80 (1999).
Ramjee et al., "Adaptive Playout Mechanisms for Packetized Audio Applications in Wide-Area Networks," 0743-166X/94 IEEE, pp. 680-688 (1994).
S.A. Ramprashad, "A Multimode Transform Predictive Coder (MTPC) for Speech and Audio," in Proc. IEEE Workshop on Speech Coding, pp. 10-12, 1999.
Salami et al., "The Adaptive Multi-Rate Wideband Codec: History and Performance," Proc. IEEE Workshop on Speech Coding, 2002, pp. 144-146 (2002).
Salami et al., "A robust transformed binary vector excited coder with embedded error-correction coding," IEEE Colloquium on Speech Coding, pp. 5/1-5/6 (1989).
Salami, et al., "A wideband codec at 16/24 kbit/s with 10 ms frames," Sep. 1997, 1997 Workshop on Speech Coding for Telecommunications, pp. 103-104.
Saunders, J., "Real Time Distribution of Broadcast Speech/Music," *Proceedings of IEEE International Conference on Acoustics, Speech, and Signal Processing*, vol. 2, pp. 993-996 (May 1996).
Scheirer, E., et al., "Construction and Evaluation of a Robust Multifeature Speech/Music Discriminator," *In Proceedings of IEEE International Conference on Acoustics, Speech, and Signal Processing*, vol. 2, pp. 1331-1334, (Apr. 1997).
J. Schnitzler, J. Eggers, C. Erdmann and P. Vary, "Wideband Speech Coding Using Forward/Backward Adaptive Prediction with Mixed Time/Frequency Domain Excitation," in Proc. IEEE Workshop on Speech Coding, pp. 3-5, 1999.
Schroeder et al., "Code-Excited Linear Prediction (CELP): High-Quality Speech at Very Low Bites Rates," CH2118-8/85/0000-0937 IEEE, pp. 937-940 (1985).
Sreenan et al., "Delay Reduction Techniques for Playout Buffering," IEEE Transactions on Multimedia, vol. 2, No. 2, pp. 88-100 (2000).
Swaminathan et al., "A Robust Low Rate Voice Codec for Wirleess Communications," Proc. 1997 IEEE Workshop on Speech Coding for Telecommunications, pp. 75-76 (1997).
L. Tancerel, R. Vesa, V. T. Ruoppila and R. Lefebvre, "Combined Speech and Audio Coding by Discrimination," in Proc. IEEE Workshop on Speech Coding, pp. 154-156, 2000.
Tasaki et al., "Post Noise Smoother to Improve Low Bit Rate Speech-Coding Performance," 0-7803-5651-9/99 IEEE, pp. 159-161 (1999).
Tasaki et al., "Spectral Postfilter Design Based on LSP Transformation," 0-7803-4073-6/97 IEEE, pp. 57-58 (1997).
Taumi et al., "13kbps Low-Delay Error-Robust Speech Coding for GSM EFR," 1995 IEEE Workshop on Speech Coding for Telecommunications, pp. 61-62 (1995).
Tzanetakis G., et al., "Multifeature Audio Segmentation for Browsing and Annotation," *Proc. IEEE Workshop on Applications of Signal Processing to Audio and Acoustics*, New Paltz, NY, 103-106 (Oct. 1999).
A. Ubale and A. Gersho, "Multi-Band CELP Wideband Speech Coder," Proc. IEEE Int. Conf. on Acoustics, Speech and Signal Processing, Munich, pp. 1367-1370.
Wang et al., "A 1200/2400 BPS Coding Suite Based on MELP," Proc. IEEE Workshop on Speech Coding, 2002, pp. 90-92 (2002).
Wang et al., "Performance Comparison of Intraframe and Interframe LSF Quantization in Packet Networks," Proc. IEEE Workshop on Speech Coding, 2000, pp. 126-128 (2000).
Wang et al., "Wideband Speech Coder Employing T-codes and Reversible Variable Length Codes," Proc. IEEE Workshop on Speech Coding, 2002, pp. 117-119 (2002).
Mouy, B., et al., "NATO Stang 4479: A Standard for an 800 BPS Vocoder and Channel Coding in HF-ECCM System", *in Proceedings of the IEEE International Conference on Acoustics, Speech and Signal Processing* (*ICASSP*), May 9, 1995, pp. 480-483.
Wang, Tian et al., "A 1200 BPS Speech Coder Based on MELP", *in Proceedings of the IEEE International Conference on Acoustics, Speech and Signal Processing*, Jun. 2000, pp. 1375-1378.
Gersho, A., "Advances In Speech and Audio Compression", *Proceedings of the IEEE*, vol. 82(6):900-918 (Jun. 1994).
McCree, et al., "A 2.4 Kbit/s MELP Coder Candidate for the New U.S. Federal Standard", *1996 IEEE International Conference on Acoustics, Speech, and Signal Processing Conference Proceedings*, Atlanta, GA (Cat. No. 96CH35903), vol. 1, pp. 200-203, May 7-10, 1996.
Supplee, L.M., et al., "MELP: The New Federal Standard at 2400 BPS", *1997 IEEE International Conference on Acoustics, Speech and Signal Processing Proceedings* (Cat. No. 97CB36052), Munich, Germany, vol. 2, pp. 21-24, Apr. 1997.
McCree, A.V., et al., "A Mixed Excitation LPC Vocoder Model for Low Bit Rate Speech Coding," *IEEE Transactions on Speech and Audio Processing*, vol. 3(4):242-250 (Jul. 1995).
Supplee, Lyn M. et al., "MLP: The New Federal Standard at 2400 BPS", *IEEE* 1997, pp. 1591-1594 in lieu of the following which we are unable to obtain *Specification for the Analog to Digital Conversion of Voice by 2,400 Bit/Second Mixed Excitation Linear Prediction FIPS, Draft document of proposed Federal Standard*, dated May 28, 1998.
Gersho, A., et al., "Vector Quantization and Signal Compression", Dordrecht, Netherlands,: Kluwer *Academics Publishers*, 1992, xxii+732pp.
LeBlanc, W.P., et al., "Efficient Search and Design Procedures for Robust Multi-Stage VQ of LPC Parameters for 4 KB/S Speech Coding". In *IEEE Trans. Speech & Audio Processing*, vol. 1, pp. 272-285, (Oct. 1993).
Mouy, B.M.; De La Noure, P.E., "Voice Transmission at a Very Low Bit Rate on A Noisy Channel: 800 BPS Vocoder with Error Protection to 1200 BPS", *ICASSP-92: 1992 IEEE International Conference on Acoustics, Speech, and Signal*, San Francisco, CA, USA, Mar. 23-26, 1992, New York, NY, USA: *IEEE*, 1992 vol. 2, pp. 149-152.
Mouy, B. et al., "Nato Stanag 4479: A Standard For An 800 BPS Vocoder and Channel Coding in HF-ECCM System", 1995 International Conference on Acoustics, Speech, and Signal Processing Conference Proceedings, Detroit MI, USA, May 9-12, 1999; New York, NY, USA: *IEEE*, vol. 1, pp. 480-483.
Kemp, D.P.; Collura J.S.; Tremain, T.E., Multi-Frame Coding of LPC Acoustics, Speech, and Signal Processing, Toronto, Ont., Canada, May 14-17, 1991; New York, N.Y. USA, *IEEE*, 1991, vol. 1, pp. 609-612.
Hardwick, J.C.; Lim, J.S., "A 4.8 KBPS Multi-Brand Excitation Speech Coder", *ICASSP 1998 International Conference on Acoustics, Speech, and Signal*, New York, NY, USA, Apr. 11-14, 1988,: *IEEE*, vol. 1, pp. 374-377.
Nishiguchi, L.; Iijima, K.; Matsumoto, J., "Harmonic Vector Excitation Coding of Speech at 2.0 KPS", *1997 IEEE Workshop on Speech coding for telecommunication proceedings*, Pocono Manor, PA, USA, Sep. 7-10, 1997, New York, NY, USA,: *IEEE*, 1997, pp. 39-40.
Nomura, T.; Iwadare, M.; Serizawa, M.; Ozawa, K., "a Bitrate and Bandwidth Scalable Celp Coder", *ICASSP 1998 International Conference on Acoustics, Speech, and Signal*, Seattle, WA, USA, May 12-15, 1998, *IEEE*, 1998, vol. 1, pp. 341-344.

* cited by examiner

LPC-HARMONIC VOCODER WITH SUPERFRAME STRUCTURE

STATEMENT REGARDING FEDERALLY SPONSORED RESEARCH OR DEVELOPMENT

This invention was made with U.S. Government Support under Contract No. MDA904-98-C-A857, awarded by the Department of Defense. The U.S. Government has certain rights in the invention.

CROSS-REFERENCE TO RELATED APPLICATIONS

Not Applicable

REFERENCE TO A MICROFICHE APPENDIX

Not Applicable

INCORPORATION BY REFERENCE

The following patents and publications which are sometimes referenced using numbers inside square brackets (e.g., [1]) are incorporated herein by reference:

[1] Gersho, A., "ADVANCES IN SPEECH AND AUDIO COMPRESSION", Proceedings of the IEEE, Vol. 82, No. 6, pp. 900-918, June 1994.

[2] McCree et al., "A 2.4 KBIT/S MELP CODER CANDIDATE FOR THE NEW U.S. FEDERAL STANDARD", 1996 IEEE International Conference on Acoustics, Speech, and Signal Processing Conference Proceedings, Atlanta, GA (Cat. No. 96CH35903), Vol. 1., pp.. 200-203, 7-10 May 1996.

[3] Supplee, L. M. et al., "MELP: THE NEW FEDERAL STANDARD AT 2400 BPS", 1997 IEEE International Conference on Acoustics, Speech, and Signal Processing proceedings (Cat. No. 97CB36052), Munich, Germany, Vol. 2, pp. 21-24 April 1997.

[4] McCree, A.V. et al., "A MIXED EXCITATION LPC VOCODER MODEL FOR LOW BIT RATE SPEECH CODING", IEEE Transactions on Speech and Audio Processing, Vol. 3, No. 4, pp. 242-250, July 1995.

[5] Specifications for the Analog to Digital Conversion of Voice by 2,400 Bit/Second Mixed Excitation Linear Prediction FIPS, Draft document of proposed federal standard, dated May 28, 1998.

[6] U.S. Patent No. 5,699,477.

[7] Gersho, A. et al., "VECTOR QUANTIZATION AND SIGNAL COMPRESSION", Dordrecht, Netherlands: Kluwer Academic Publishers, 1992, xxii+732 pp.

[8] W. P. LeBlanc, et al., "EFFICIENT SEARCH AND DESIGN PROCEDURES FOR ROBUST MULTI-STAGE VQ OF LPC PARAMETERS FOR 4 KB/S SPEECH CODING"in IEEE Trans. Speech & Audio Processing, Vol. 1, pp. 272-285, Oct. 1993.

[9] Mouy, B. M.; de la Noue, P.E., "VOICE TRANSMISSION AT A VERY LOW BIT RATE ON A NOISY CHANNEL: 800 BPS VOCODER WITH ERROR PROTECTION TO 1200 BPS", ICASSP-92: 1992 IEEE International Conference Acoustics, Speech and Signal, San Francisco, Calif., USA, 23-26 March 1992, New York, NY, USA: IEEE, 1992, Vol. 2, pp. 149-152.

[10] Mouy, B.; De La Noue, P.; Goudezeune, G. "NATO STANAG 4479: A STANDARD FOR AN 800 BPS VOCODER AND CHANNEL CODING IN HF-ECCM SYSTEM", 1995 International Conference on Acoustics, Speech, and Signal Processing. Conference Proceedings, Detroit, MI, USA, 9-12 May 1995; New York, NY, USA: IEEE, 1995, Vol. 1, pp. 480-483

[11] Kemp, D. P.; Collura, J. S.; Tremain, T. E. "MULTI-FRAME CODING OF LPC PARAMETERS 600-800 BPS", ICASSP 91, 1991 International Conference on Acoustics, Speech and Signal Processing, Toronto, Ont., Canada, 14-17 May 1991; New York, N.Y., USA: IEEE, 1991, Vol. 1, pp. 609-612.

[12] U.S. Patent No. 5,255,339.

[13] U.S. Patent No. 4,815,134.

[14] Hardwick, J.C.; Lim, J. S., "A 4.8 KBPS MULTI-BAND EXCITATION SPEECH CODER", ICASSP 1988 International Conference on Acoustics, Speech, and Signal, New York, N.Y., USA, 11-14 April 1988, New York, N.Y., USA: IEEE, 1988. Vol. 1, pp. 374-377.

[15] Nishiguchi, L.; Iijima, K.; Matsumoto, J, "HARMONIC VECTOR EXCITATION CODING OF SPEECH AT 2.0 KBPS", 1997 IEEE Workshop on Speech Coding for Telecommunications Proceedings, Pocono Manor, PA, USA, 7-10 Sept. 1997, New York, N.Y., USA: IEEE, 1997, pp. 39-40.

[16] Nomura, T., Iwadare, M., Serizawa, M., Ozawa, K., "A BITRATE AND BANDWIDTH SCALABLE CELP CODER", ICASSP 1998 International Conference on Acoustics, Speech, and Signal, Seattle, Wash., USA, 12-15 May 1998, IEEE, 1998, Vol. 1, pp. 341-344.

BACKGROUND OF THE INVENTION

1. Field of the Invention

This invention relates generally to digital communications and, in particular, to parametric speech coding and decoding methods and apparatus.

2. Description of the Background Art

For the purpose of definition, it should be noted that the term "vocoder" is frequently used to describe voice coding methods wherein voice parameters are transmitted instead of digitized waveform samples. In the production of digitized waveform samples, an incoming waveform is periodically sampled and digitized into a stream of digitized waveform data which can be converted back to an analog waveform virtually identical to the original waveform. The encoding of a voice using voice parameters provides sufficient accuracy to allow subsequent synthesis of a voice which is substantially similar to the one encoded. Note that the use of voice parameter encoding does not provide sufficient information to exactly reproduce the voice waveform, as is the case with digitized waveforms; however the voice can be encoded at a lower data rate than is required with waveform samples.

In the speech coding community, the term "coder" is often used to refer to a speech encoding and decoding system, although it also often refers to an encoder by itself. As used herein, the term encoder generally refers to the encoding operation of mapping a speech signal to a compressed data signal (the bitstream), and the term decoder generally refers to the decoding operation where the data signal is mapped into a reconstructed or synthesized speech signal.

Digital compression of speech (also called voice compression) is increasingly important for modern communication systems. The need for low bit rates in the range of 500 bps (bits per second) to 2 kbps (kilobits per second) for transmission of voice is desirable for efficient and secure voice communication over high frequency (HF) and other radio channels, for satellite voice paging systems, for multiplayer Internet games, and numerous additional applications. Most compression methods (also called "coding methods") for 2.4 kbps, or below, are based on parametric vocoders. The majority of contemporary vocoders of interest are based on variations of the classical linear predictive coding (LPC) vocoder and enhancements of that technique, or are based on sinusoidal coding methods such as harmonic coders and multiband excitation coders [1]. Recently an enhanced version of the LPC vocoder has been developed which is called MELP (Mixed Excitation Linear Prediction) [2, 5, 6]. The present invention can provide similar voice quality levels at a lower bit rate than is required in the conventional encoding methods described above.

This invention is generally described in relation to its use with MELP, since MELP coding has advantages over other frame-based coding methods. However the invention is applicable to a variety of coders, such as harmonic coders [15], or multiband excitation (MBE) type coders [14].

The MELP encoder observes the input speech and, for each 22.5 ms frame, it generates data for transmission to a decoder. This data consists of bits representing line spectral frequencies (LSFs) (which is a form of linear prediction parameter), Fourier magnitudes (sometimes called "spectral magnitudes), gains (2 per frame), pitch and voicing, and additionally contains an aperiodic flag bit, error protection bits, and a synchronization (sync) bit. FIG. 1 shows the buffer structure used in a conventional 2.4 kbps MELP encoder. The encoder employed with other harmonic or MBE coding methods generates data representing many of the same or similar parameters (typically these are LSFs, spectral magnitudes, gain, pitch, and voicing). The MELP decoder receives these parameters for each frame and synthesizes a corresponding frame of speech that approximates the original frame.

Different communication systems require speech coders with different bit-rates. For example, a high frequency (HF) radio channel may have severely limited capacity and require extensive error correction and a bit rate of 1.2 kbps may be most suitable for representing the speech parameters, whereas a secure voice telephone communication system often requires a bit rate of 2.4 kbps. In some applications it is necessary to interconnect different communication systems so that a voice signal originally encoded for one system at one bit rate is subsequently converted into an encoded voice signal at the other bit rate for another system. This conversion is referred to as "transcoding", and it can be performed by a "transcoder" typically located at a gateway between two communication systems.

BRIEF SUMMARY OF THE INVENTION

In general terms, the present invention takes an existing vocoder technique, such as MELP and substantially reduces the bit rate, typically by a factor of two, while maintaining approximately the same reproduced voice quality. The existing vocoder techniques are made use of within the invention, and they are therefore referred to as "baseline" coding or alternately "conventional" parametric voice encoding.

By way of example, and not of limitation, the present invention comprises a 1.2 kbps vocoder that has analysis modules similar to a 2.4 kbps MELP coder to which an additional superframe vocoder is overlayed. A block or "superframe" structure comprising three consecutive frames is adopted within the superframe vocoder to more efficiently quantize the parameters that are to be transmitted for the 1.2 kbps vocoder of the present invention. To simplify the description, the superframe is chosen to encode three frames, as this ratio has been found to perform well. It should be noted, however, that the inventive methods can be applied to superframes comprising any discrete number of frames. A superframe structure has been mentioned in previous patents and publications [9], [10], [11], [13]. Within the MELP coding standard, each time a frame is analyzed (e.g., every 22.5 ms), its parameters are encoded and transmitted. However, in the present invention each frame of a superframe is concurrently available in a buffer, each frame is analyzed, and the parameters of all three frames within the superframe are simultaneously available for quantization. Although this introduces additional encoding delay, the temporal correlation that exists among the parameters of the three frames can be efficiently exploited by quantizing them together rather than separately.

The frame size of the 1.2 kbps coder of the present invention is preferably 22.5 ms (or 180 samples of speech) at a sampling rate of 8000 samples per second, which is the same as in the MELP standard coder. However, in order to avoid large pitch errors, the length of the look-ahead is increased in the invention by 129 samples. In this regard, note that the term "look-ahead" refers to the time duration of the "future" speech segment beyond the current frame boundary that must be available in the buffer for processing needed to encode the current frame. A pitch smoother is also used in the 1.2 kbps coder of the present invention, and the algorithmic delay for the 1.2 kbps coder is 103.75 ms. The transmitted parameters for the 1.2 kbps coder are the same as for the 2.4 kbps MELP coder.

Within the MELP coding standard, the low band voicing decision or Unvoiced/Voiced decision (UN decision) is found for each frame. The frame is said to be "voiced" when the low band voicing value is "1", and "unvoiced" when it is "0". This voicing condition determines which of two different bit allocations is used for the frame. However, in the 1.2 kbps coder of the present invention, each superframe is categorized into one of several coding states with a different bit allocation for each state. State selection is done according to the U/V (unvoiced or voiced) pattern of the superframe. If a channel bit error leads to an incorrect state identification by the decoder, serious degradation of the synthesized speech for that superframe will result. Therefore an aspect of the present invention comprises techniques to reduce the effect of state mismatch between encoder and decoder due to channel errors, which techniques have been developed and integrated into the decoder.

In the present invention, three frames of speech are simultaneously available in a memory buffer and each frame is separately analyzed by conventional MELP analysis modules, generating (unquantized) parameter values for each of the three frames. These parameters are collectively available for subsequent processing and quantization. The pitch smoother observes pitch and U/V decisions for the three frames and also performs additional analysis on the buffered speech data to extract parameters needed to classify each frame as one of two types (onset or offset) for use in a pitch smoothing operation. The smoother then outputs modified (smoothed) versions of the pitch decisions, and these pitch values for the superframe are then quantized. The bandpass voicing smoother observes the bandpass voicing strengths for the three frames, as well as examines energy values extracted directly from the buffered speech, and then determines a cutoff frequency for each of the three frames. The bandpass voicing strengths are parameters generated by the MELP encoder to describe the degree of voicing in each of five frequency bands of the speech spectrum. The cutoff frequencies, defined later, describe the time evolution of the bandwidth of the voiced part of the speech spectrum. The cutoff frequency for each voiced frame in the superframe is encoded with 2 bits. The LSF parameters, Jitter parameter, and Fourier magnitude parameters for the superframe are each quantized. Binary data is obtained from the quantizers for transmission. Not described for the sake of simplicity are the error correction bits, synchronization bit, parity bit, and the multiplexing of the bits into a serial data stream for transmission, all of which are well-known to those skilled in the art. At the receiver, the data bits for the various parameters are extracted, decoded and applied to inverse quantizers that recreate the quantized parameter values from the compressed data. A receiver typically includes a synchronization module which identifies the starting point of a superframe, and a means for error correction decoding and demultiplexing. The recovered parameters for each frame can be applied to a synthesizer. After decoding, the synthesized speech frames are concatenated to form the speech output signal. The synthesizer may be a conventional frame-based synthesizer, such as MELP, or it may be provided by an alternative method as disclosed herein.

An object of the invention is to introduce greater coding efficiencies and exploit the correlation from one frame of speech to another by grouping frames into superframes and performing novel quantization techniques on the superframe parameters.

Another object of the invention is to allow the existing speech processing functions of the baseline encoder and decoder to be retained so that the enhanced coder operates on the parameters found in the baseline coder operation, thereby preserving the wealth of experimentation and design results already obtained with baseline encoders and decoders while still offering greatly reduced bit rates.

Another object of the invention is to provide a mechanism for transcoding, wherein a bit stream obtained from the enhanced encoder is converted (transcoded) into a bit stream that will be recognized by the baseline decoder, while similarly providing a way to convert the bit stream coming from a baseline encoder into a bit stream that can be recognized by an enhanced decoder. This transcoding feature is important in applications where terminal equipment implementing a baseline coder/decoder must communicate with terminal equipment implementing the enhanced coder/decoder.

Another object of the invention is to provide methods for improving the performance of the MELP encoder by wherein new methods generate pitch and voicing parameters.

Another object of the invention is to provide a new decoding procedure that replaces the MELP decoding procedure and substantially reduces complexity while maintaining the synthesized voice quality.

Another object of the invention is to provide a 1.2 kbps coding scheme that gives approximately equal quality to the MELP standard coder operating at 2.4 kbps.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

For illustrative purposes the present invention will be described with reference to FIG. 2 through FIG. 6. It will be appreciated that the apparatus may vary as to configuration and as to details of the parts, and that the method may vary as to the specific steps and sequence, without departing from the basic concepts as disclosed herein.

1. OVERVIEW OF THE VOCODER

The 1.2 kbps encoder of the present invention employs analysis modules similar to those used in a conventional 2.4 kbps MELP coder, but adds a block or "superframe" encoder which encodes three consecutive frames and quantizes the transmitted parameters more efficiently to provide the 1.2 kbps vocoding. Those skilled in the art will appreciate that although the invention is described with reference to using three frames per superframe, the method of the invention can be applied to superframes comprising other integral numbers of frames as well. Furthermore, those skilled in the art will also appreciate that although the invention is described with respect to the use of MELP as the baseline coder, the methods of the invention can be applied to other harmonic vocoders. Such vocoders may have a similar, but not identical, set of parameters extracted from analysis of a speech frame and the frame size and bit rates may be different from those used in the description presented here.

It will be appreciated that when a frame is analyzed within a MELP encoder, (e.g. every 22.5 ms), voice parameters are encoded for each frame and then transmitted. Yet, in the present invention, data from a group of frames, forming a superframe, is collected and processed with the parameters of all three frames in the superframe which are simultaneously available for quantization. Although this introduces additional encoding delay, the temporal correlation that exists among the parameters of the three frames can be efficiently exploited by quantizing them together rather than separately.

Figure 1:
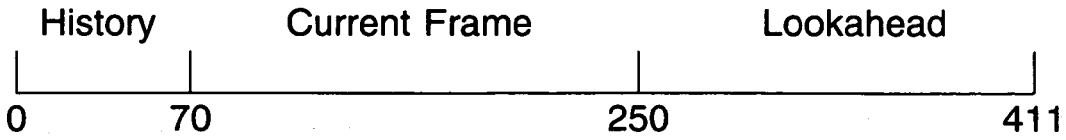
FIG. – 1 (Prior Art)
FIG. 1 is a diagram of data positions used within the input speech buffer structure of a conventional 2.4 kbps MELP coder. The units shown indicate samples of speech.

The frame size employed in the present invention is preferably 22.5 ms (or 180 samples of speech) at a sampling rate of 8000 samples per second, which is the same sample rate used in the original MELP coder. The buffer structure of a conventional 2.4 kbps MELP is shown in FIG. 1. The length of look-ahead buffer has been increased in the preferred embodiment by 129 samples, so as to reduce the occurrence of large pitch errors, although the invention can be practiced with various levels of look-ahead. Additionally, a pitch smoother has been introduced to further reduce pitch errors. The algorithmic delay for the 1.2 kbps coder described is 103.75 ms. The transmitted parameters for the 1.2 kbps coder are the same as for the 2.4 kbps MELP coder. The buffer structure of the present invention can be seen in FIG. 2.

1.1 Bit Allocation

When using MELP coding, the low band voicing decision, or U/V decision, is found for each "voiced" frame when the low band voicing value is 1 and unvoiced when it is 0. However in the 1.2 kbps coder of the present invention each superframe is categorized into one of several coding states employing different quantization schemes. State selection is performed according to the U/V pattern of the superframe. If a channel bit error leads to an incorrect state identification by the decoder, serious degradation of the synthesized speech for that superframe will result. Therefore, techniques to reduce the effect of state mismatch between encoder and decoder due to channel errors have been developed and integrated into the decoder. For comparison purposes, the bit allocation schemes for both the 2.4 kbps (MELP) coder and the 1.2 kbps coder are shown in Table 1.

Figure 2:
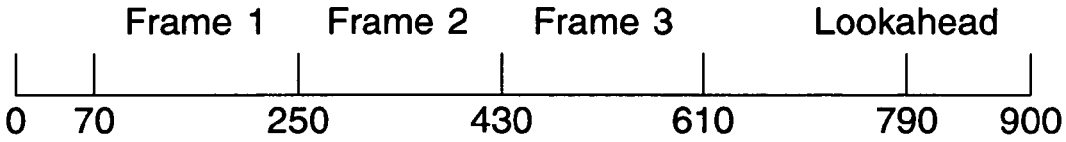
FIG. 2 is a diagram of data positions used within the input superframe speech buffer structure of the 1.2 kbps coder of the present invention. The units shown indicate samples of speech.
Figure 3A:
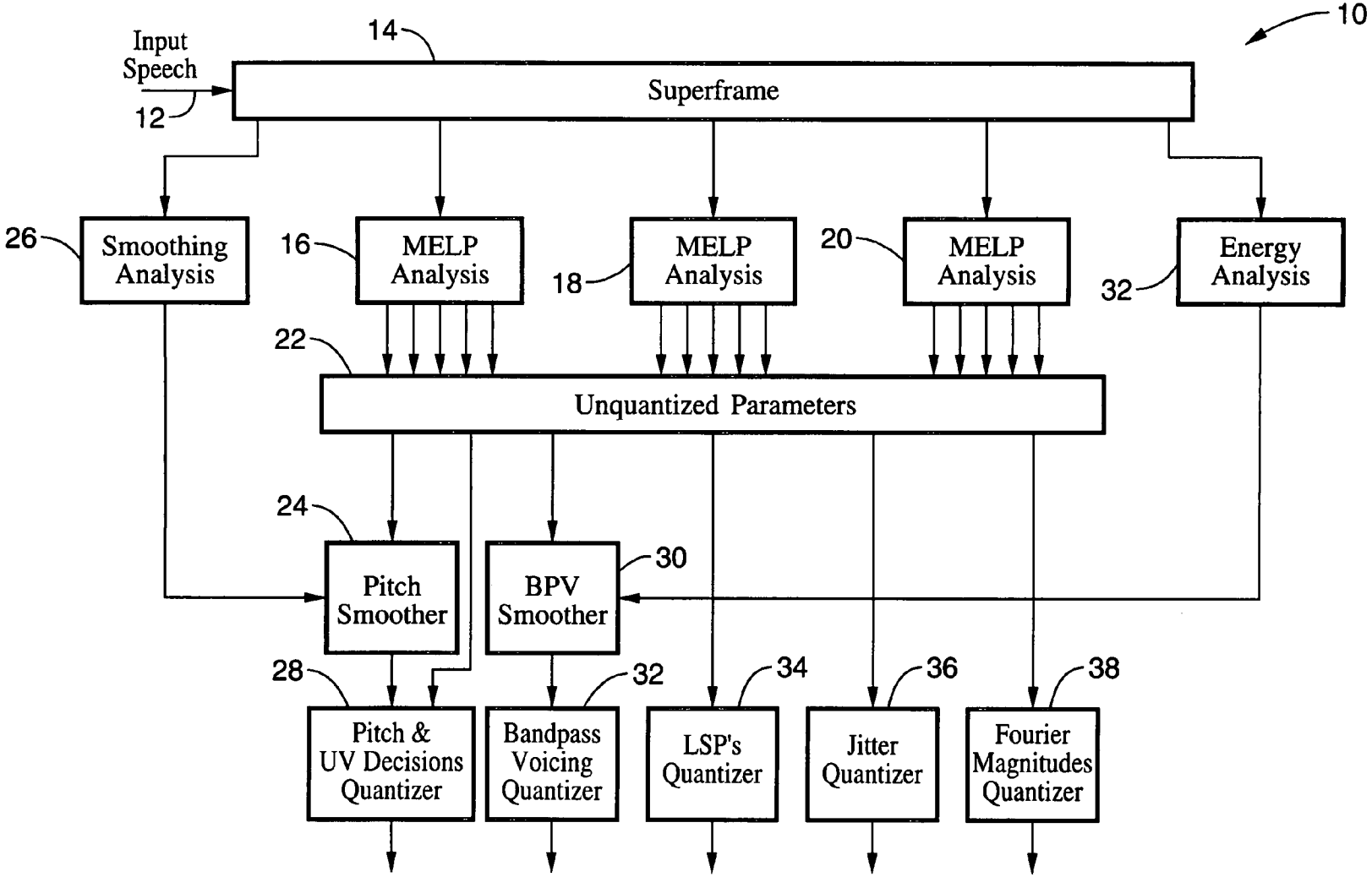
FIG. 3A is a functional block diagram of the 1.2 kbps encoder of the present invention.

FIG. 3A is a general block diagram of the 1.2 kbps coding scheme 10 in accord with the present invention. Input speech 12 fills a memory buffer called a superframe buffer 14 which comprises a superframe and in addition stores the history samples that preceded the start of the oldest of the three frames and the look-ahead samples that follow the most recent of the three frames. The actual range of samples stored in this buffer for the preferred embodiment are as shown in FIG. 2. Frames within the superframe buffer 14 are separately analyzed by conventional MELP analysis modules 16, 18, 20 which generate a set of unquantized parameter values 22 for each of the frames within the superframe buffer 14. Specifically, a MELP analysis module 16 operates on the first (oldest) frame stored in the superframe buffer, another MELP analysis module 18 operates on the second frame stored in the buffer, and another MELP analysis module 20 operates on the third (most recent) frame stored in the buffer. Each MELP analysis block has access to a frame plus prior and future samples associated with that frame. The parameters generated by the MELP analysis modules are collected to form the set of unquantized parameters stored in memory unit 22, which is available for subsequent processing and quantization. The pitch smoother 24 observes pitch values for the frames within the superframe buffer 14, in conjunction with a set of parameters computed by the smoothing analysis block 26 and outputs modified versions of the pitch values when the output is quantized 28. A bandpass voicing smoother 30 observes an average energy value computed by the energy analysis module 32 and it also observes the bandpass voicing strengths for the frames within the superframe buffer 14 and suitably modifies them for subsequent quantization by the bandpass voicing quantizer 32. An LSP quantizer 34, Jitter quantizer 36, and Fourier magnitudes quantizer 38 each output encoded data. Encoded binary data is obtained from the quantizers for transmission. Not shown for simplicity are the generation of error correction data bits, a synchronization bit, and multiplexing of the bits into a serial data stream for transmission which those skilled in the art will readily understand how to implement.

Figure 3B:
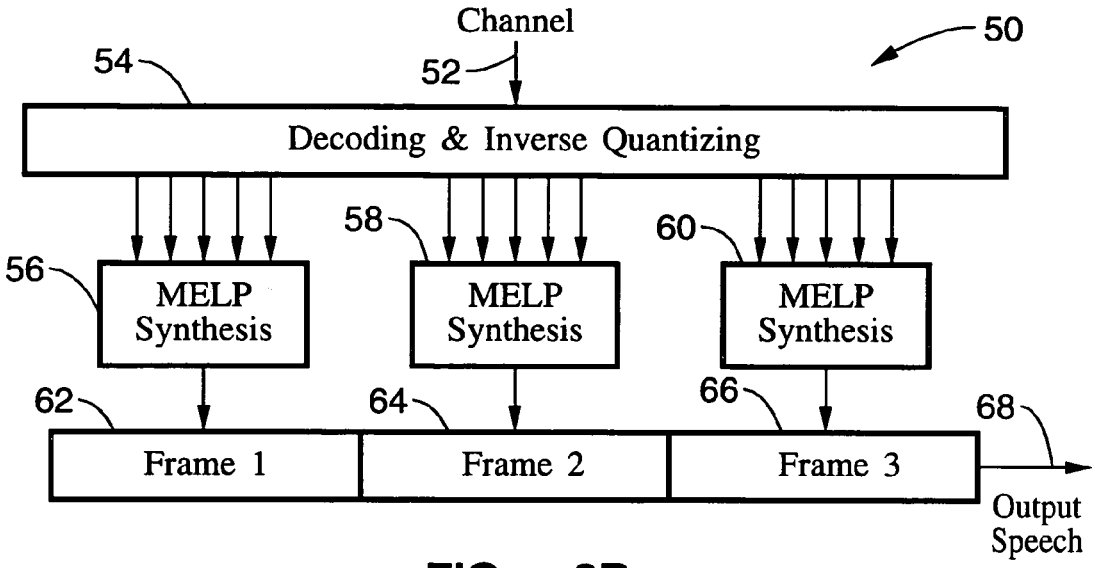
FIG. 3B is a functional block diagram of the 1.2 kbps decoder of the present invention.

At the decoder 50, shown in FIG. 3B, the data bits for the various parameters are contained in the channel data 52 which enters a decoding and inverse quantizer 54, which extracts, decodes and applies inverse quantizers to recreate the quantized parameter values from the compressed data. Not shown are the synchronization module (which identifies the starting point of a superframe) and the error correction decoding and demultiplexing which those skilled in the art will readily understand how to implement. The recovered parameters for each frame are then applied to conventional MELP synthesizers 56, 58, 60. It should be noted that this invention includes an alternative method of synthesizing speech for each frame that is entirely different from the prior art MELP synthesizer. After being decoded, the synthesized speech frames 62, 64, 66 are concatenated to form the speech output signal 68.

2. SPEECH ANALYSIS 2.1 Overview

The basic structure of the encoder is based on the same analysis module used in the 2.4 kbps MELP coder except that a new pitch smoother and bandpass-voicing smoother are added to take advantage of the superframe structure. The coder extracts the feature parameters from three successive frames in a superframe using the same MELP analysis algorithm, operating on each frame, as used in the 2.4 kbps MELP coder. The pitch and bandpass voicing parameters are enhanced by smoothing. This enhancement is possible because of the simultaneous availability of three adjacent frames and the look-ahead. By operating in this manner on the superframe, the parameters for all three frames are available as input data to the quantization modules, thereby allowing more efficient quantization than is possible when each frame is separately and independently quantized.

2.2 Pitch Smoother

Figure 4:
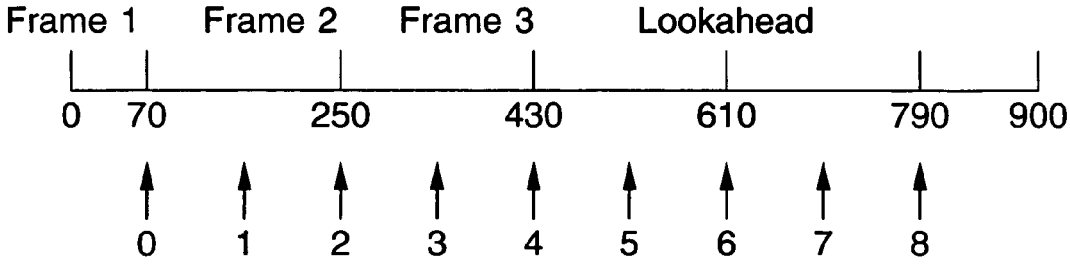
FIG. 4 is a diagram of data positions within the 1.2 kbps encoder of the present invention showing computation positions for computing pitch smoother parameters within the present invention, where the units shown indicate samples of speech.
Figure 5A:
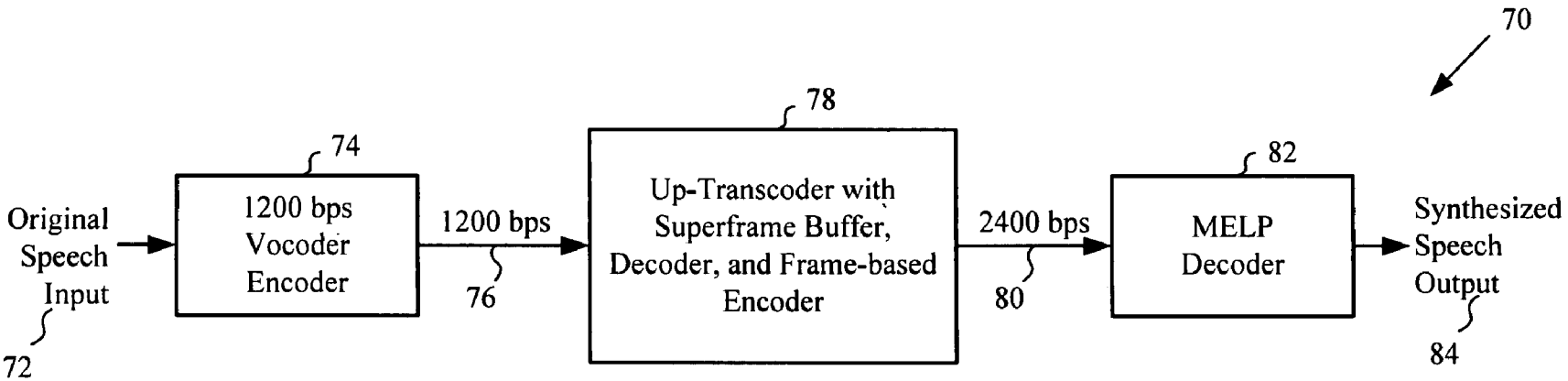
FIG. 5A is a functional block diagram of a 1200 bps stream up-converted by a transcoder into a 2400 bps stream.
Figure 5B:
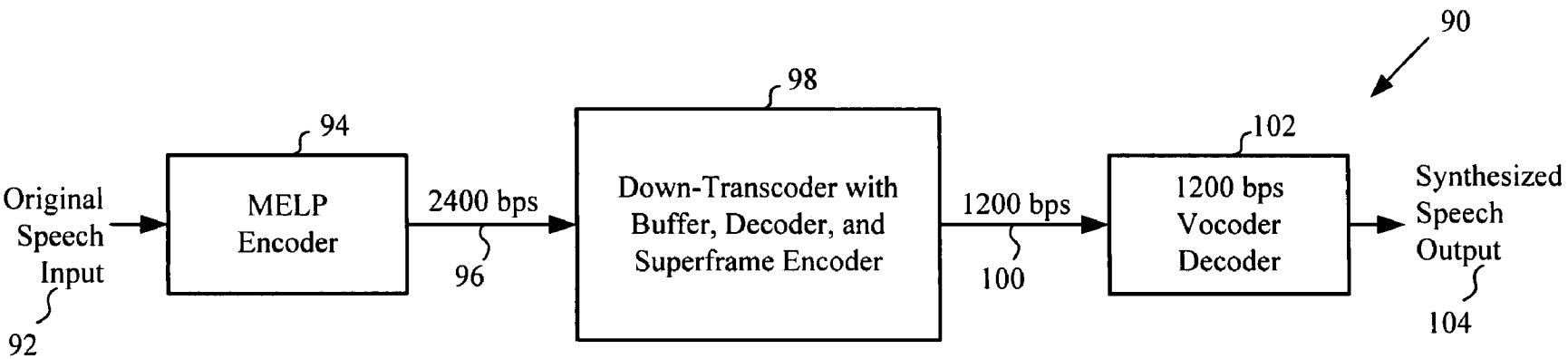
FIG. 5B is a functional block diagram of a 2400 bps stream down-converted by an transcoder into a 1200 bps stream.

The pitch smoother takes the pitch estimates from the MELP analysis module for each frame in the superframe and a set of parameters from the smoothing analysis module 26 shown in FIG. 3A. The smoothing analysis module 26 computes a set of new parameters every half frame (11.25 ms) from direct observation of the speech samples stored in the superframe buffer. The nine computation positions in the current superframe are illustrated in FIG. 4. Each computation position is at the center of a window in which the parameters are computed. The computed parameters are then applied as additional information to the pitch smoother.

In the 1.2 kbps encoder, each frame is classified into two categories, comprising either onset or offset frames in order to guide the pitch smoothing process. The new waveform feature parameters computed by the smoothing analysis module 26, and then used by the pitch smoother module 24 for the onset/offset classification, are as follows:

| Description | Abbreviation |
|---|---|
| energy in dB | subEnergy |
| zero crossing rate | zeroCrosRate |
| peakiness measurement | peakiness |
| maximum correlation coefficient of input speech | corx |
| maximum correlation coefficient of 500 Hz low pass filtered speech | lowBandCorx |
| Energy of low pass filtered speech | lowBandEn |
| Energy of high pass filtered speech | highBandEn |

Input speech is denoted as x(n),n=. . . , 0, 1, . . . where x(0) corresponds to the speech sample that is 45 samples to the left of the current computation position, and n is 90 samples, which is half of the frame size. The parameters are computed as following (1) Energy:

$$subEnergy = 10\log_{10}\left[\sum_{n=0}^{N-1} x^2(n)\right]$$

(2) Zero crossing rate:

$$zeroCrossRate = \sum_{i=0}^{N-2} [x(i) * x(i+1) > 0 ? 0 : 1]$$

where the expression in square brackets has value 1 when the product x(i)*x(i+1) is negative (i.e., when a zero crossing occurs) and otherwise it has value zero.

(3) Peakiness measurement in speech domain:

$$peakiness = \frac{\sqrt{\sum_{n=0}^{N-1} x^2(n)/N}}{\sum_{n=0}^{N-1} |x(n)|}$$

The peakiness measure is defined as in the MELP coder [5], however, here this measure is computed from the speech signal itself, whereas in MELP it is computed from the prediction residual signal that is derived from the speech signal.

(4) Maximum correlation coefficient in pitch search range:

First the input speech signal is passed through a low-pass filter with an 800 Hz cutoff frequency, where:

$$H(z)=0.3069/(1-2.4552z^{-1}+2.4552z^{-2}-1.152z^{-3}+0.2099z^{-4})$$

The low-pass filtered signal is passed through a $2^{nd}$ order LPC inverse filter. The inverse filtered signal is denoted as $S_{lv}(n)$ . The DC component is removed from $s_{lv}(n)$ to obtain $\bar{s}_{lv}(n)$ . Then, the autocorrelation function is computed by:

$$r_k = \frac{\sum_{n=0}^{M-1} \bar{s}_{lv}(n)\bar{s}_{lv}(n+k)}{\sqrt{\sum_{n=0}^{M-1} \bar{s}_{lv}^2(n) \cdot \sum_{n=0}^{M-1} \bar{s}_{lv}^2(n+k)}} \quad k = 20, \ldots, 150$$

where M=70. The samples are selected using a sliding window chosen to align the current computation position to the center of the autocorrelation window. The maximum correlation coefficient parameter corx is the maximum of the function $r_k$. The corresponding pitch is l.

$$corx = \max_{20 \le k \le 150} r_k \quad l = \arg\max_{20 \le k \le 150} r_k$$

(5) Maximum correlation coefficient of low pass filtered speech:

In the standard MELP, five filters are used in bandpass voicing analysis. The first filter is actually a low-pass filter with passband of 0-500 Hz. The same filter is used on input speech to generate the low-pass filtered signal $s_l$ (n) . Then the correlation function defined in (4) is computed on $s_l$ (n) . The range of the indices is limited by [max(20, l−5), min(150, l+5)]. The maximum of the correlation function is denoted as lowBandCorx.

(6) Low band energy and high band energy:

In the LPC analysis module, the first 17 autocorrelation coefficients r(n), n=0, . . . , 16 are computed. The low band energy and high band energy are obtained by filtering the autocorrelation coefficients.

$$lowBandEn = r(0) \cdot C_l(0) + 2\sum_{n=1}^{16} r(n) \cdot C_l(n)$$

$$highBandEn = r(0) \cdot C_h(0) + 2\sum_{n=1}^{16} r(n) \cdot C_h(n)$$

The $C_l$ (n) and $C_h$ (n) are the coefficients for low pass filter and the high pass filter. The 16 filter coefficients for each filter are chosen for a cutoff frequency of 2 kHz and are obtained with a standard FIR filter design technique.

The parameters enumerated above are used to make rough U/V decisions for each half frame. The classification logic for making the voicing decisions shown below is performed in the pitch smoother module 24. The voicedEn and silenceEn are the running average energies of voiced frames and silence frames.

```
structure {
  subEnergy;      /* energy in dB */
  zeroCorsRate;   /* zero crossing rate */
  peakiness;      /* peakiness measurement */
  corx;           /* maximum correlation coefficient of input speech */
  lowBandCorx;    /* maximum correlation coefficient of
                     500 Hz low pass filtered speech */
  lowBand En;     /* Energy of low pass filtered speech */
  highBandEn;     /* Energy of high pass filtered speech */
} classStat[9];
if( classStat -> subEnergy < 30 ){
  classy = SILENCE;
}else if( classStat -> subEnergy < 0.35*voicedEn + 0.65*silenceEn ){
  if( (classStat->zeroCrosRate > 0.6) &&
    ((classStat->corx<0.4) || (classStat->lowBandCorx < 0.5)) )
    classy = UNVOICED;
  else if( (classStat->lowBandCorx > 0.7) ||
    ((classStat->lowBandCorx > 0.4) && (classStat->corx > 0.7)) )
    classy = VOICED;
  else if( (classStat->zeroCrosRate-classStat[-1].zeroCrosRate>0.3) ||
      (classStat->subEnergy - classStat[-1].subEnergy > 20) ||
      (classStat->peakiness > 1.6) )
    classy = TRANSITION;
  else if((classStat->zeroCrosRate > 0.55) ||
      ((classStat->highBandEn > classStat->lowBandEn-5) &&
       (classStat->zeroCrosRate > 0.4)) )
    classy = UNVOICED;
  else classy = SILENCE;
}else{
  if( (classStat->zeroCrosRate - classStat[-1].zeroCrosRate > 0.2) ||
      (classStat->subEnergy - classStat[-1].subEnergy > 20) ||
      (classStat->peakiness > 1.6) ){
    if( (classStat->lowBandCorx > 0.7) || (classStat->corx > 0.8) )
      classy = VOICED;
```

-continued

```
      else
        classy = TRANSITION;
  }else if( classStat -> zeroCrosRate < 0.2 ){
      if( (classStat->lowBandCorx > 0.5) ||
        ((classStat->lowBandCorx > 0.3) && (classStat->corx > 0.6))
        classy = VOICED;
      else if( classStat->subEnergy > 0.7*voicedEn+0.3*silenceEn ){
        if( classStat->peakiness > 1.5)
          classy = TRANSITION;
        else{
          classy = VOICED;
        }
      }else{
        classy = SILENCE;
      }
  }else if( classStat -> zeroCrosRate < 0.5 ){
      if( (classStat->lowBandCorx > 0.55) ||
       ((classStat->lowBandCorx > 0.3) && (classStat->corx > 0.65)) )
        classy = VOICED;
      else if( (classStat->subEnergy < 0.4*voicedEn+0.6*silenceEn) &&
        (classStat->highBandEn < classStat->lowBandEn-10) )
        classy = SILENCE;
      else if( classStat->peakiness > 1.4)
        classy = TRANSITION;
      else
        classy = UNVOICED;
}else if( classStat -> zeroCrosRate < 0.7 ){
      if( ((classStat->lowBandCorx > 0.6) && (classStat->corx > 0.3)) ||
       ((classStat->lowBandCorx > 0.4) && (classStat->corx > 0.7)) )
        classy = VOICED;
      else if( classStat->peakiness > 1.5 )
        classy = TRANSITION;
      else
        classy = UNVOICED;
  }else{
      if( ((classStat->lowBandCorx > 0.65) && (classStat->corx > 0.3)) ||
       ((classStat->lowBandCorx > 0.45) && (classStat->corx > 0.7)) )
        classy = VOICED;
      else if( classStat->peakiness > 2.0 )
        classy = TRANSITION;
      else
        classy = UNVOICED;
  }
}
```

The U/V decisions for each subframe are then used to classify the frames as onset or offset. This classification is internal to the encoder and is not transmitted. For each current frame, first the possibility of an offset is checked. An offset frame is selected if the current voiced frame is followed by a sequence of unvoiced frames, or the energy declines at least 8 dB within one frame or 12 dB within one and one-half frames. The pitch of an offset frame is not smoothed.

If the current frame is the first voiced frame, or the energy increases by at least 8 dB within one frame or 12 dB within one and one-half frames, the current frame is classified as an onset frame. For the onset frames, a look-ahead pitch candidate is estimated from one of the local maximums of the autocorrelation function evaluated in the look-ahead region. First, the 8 largest local maximums of the autocorrelation function given above are selected. The maximums are denoted for the current computation position as $R^{(0)}(i)$, i=0, . . . , 7. The maximums for the next two computation positions are $R^{(1)}(i)$, $R^{(2)}(i)$ . A cost function for each computation position is computed, and the cost function for the current computation position is used to estimate the predicted pitch. The cost function for $R^{(2)}(i)$ is computed first as:

$$C^{(2)}(i)=W[1-R^{(2)}(i)]$$

where W is a constant which is 100. For each maximum $R^{(1)}(i)$, the corresponding pitch is denoted as $p^{(1)}(i)$. The cost function $C^{(1)}(i)$ is computed as:

$$C^{(1)}(i)=W[1-R^{(1)}(i)]+|p^{(1)}(i)-p^{(2)}(k_i)|+C^{(2)}(k_i)$$

The index $k_i$ is chosen as:

$$k_i = \underset{l}{\operatorname{argmax}}(R^{(2)}(l)) \quad |p^{(2)}(l) - p^{(1)}(i)| / p^{(1)}(i) < 0.2$$

If the range for l is an empty set in the above equation, then we use range l∈[0, 7]. The cost function $C^{(0)}(i)$ is computed in a similar way as the $C^{(1)}(i)$. The predicted pitch is chosen as $$p = \underset{p^{(0)}(i)}{\operatorname{argmax}} \ (C^{(0)}(i)) \quad i = 0, \ldots, 7$$

The look-ahead pitch candidate is selected as current pitch, if the difference between the original pitch estimate and the look-ahead pitch is larger than 15%.

If the current frame is neither offset nor onset, the pitch variation is checked. If a pitch jump is detected, which means the pitch decreases and then increases or increases and then decreases, the pitch of the current frame is smoothed using interpolation between the pitch of the previous frame and the pitch of the next frame. For the last frame in the superframe the pitch of the next frame is not available, therefore a predicted pitch value is used instead of the next frame pitch value. The above pitch smoother detect many of the large pitch errors that would otherwise occur and in formal subjective quality tests, the pitch smoother provided significant quality improvement.

2.3 Bandpass Voicing Smoother

In MELP encoding, the input speech is filtered into five subbands. Bandpass voicing strengths are computed for each of these subbands with each voicing strength normalized to a value of between 0 and 1. These strengths are subsequently quantized to 0s or 1s, to obtain bandpass voicing decisions. The quantized lowband (0 to 500 Hz) voicing strength determines the unvoiced, or voiced, (U/V) character of the frame. The binary voicing information of the remaining four bands partially describes the harmonic or nonharmonic character of the spectrum of a frame and can be represented by a four bit codeword. In this invention, a bandpass voicing smoother is used to more compactly describe this information for each frame in a superframe and to smooth the time evolution of this information across frames. First the four bit codeword is mapped (1 for voiced, 0 for unvoiced) for the remaining four bands for each frame into a single cutoff frequency with one of four allowed values. This cutoff frequency approximately identifies the boundary between the lower region of the spectrum that has a voiced (or harmonic) character and the higher region that has an unvoiced character. The smoother then modifies the three cutoff frequencies in the superframe to produce a more natural time evolution for the spectral character of the frames. The 4-bit binary voicing codeword for each of the frame decisions is mapped into four codewords using the 2-bit codebook shown in Table 2. The entries of the codebook are equivalent to the four cutoff frequencies: 500 Hz, 1000 Hz, 2000 Hz and 4000 Hz which correspond respectively to the columns labeled: 0000, 1000, 1100, and 1111 in the mapping table given in Table 2. For example, when the bandpass voicing pattern for a voiced frame is 1001, this index is mapped into 1000, which corresponds to a cutoff frequency of 1000 Hz.

For the first two frames of the current superframe, the cutoff frequency is smoothed according to the bandpass voicing information of the previous frame and the next frame. The cutoff frequency in the third frame is left unchanged. The average energy of voiced frames is denoted as VE. The value of VE is updated at each voiced frame for which the two prior frames are voiced. The updating rule is:

$$VE_{new}=10\log_{10}[0.9e^{VE_{old}10}+0.1e^{subEnergy/10}]$$

For the frame i, the energy of the current frame is denoted as $en_i$. The voicing strengths for the five bands are denoted as $bp[k]_i$, k=1, . . . , 5. The following three conditions are considered to smooth the cutoff frequency $f_i$.

(1) If the cutoff frequencies of the previous frame and the next frame are both above 2000 Hz, then execute the following procedure.

If($f_i$<2000 and (($en_i$>$VE$−5 dB) or ($bp[2]_{i-1}$>0.5 and $bp[3]_{i-1}$>0.5)))

$f_i$=2000 Hz else if ($f_i$<1000)

$f_i$=1000 Hz (2) If the cutoff frequencies of the previous frame and the next frame are both above 1000 Hz, then execute the following procedure.

If ($f_i$<1000 and (($en_i$>VE−10 dB) or ($bp[2]_{i-1}$>0.4)))

$f_i$=1000 Hz (3) If the cutoff frequencies of the previous frame and the next frame are all below 1000 Hz, then execute the following procedure.

If ($f_i$>2000 and $en_i$<VE−5 dB and $bp[3]_{i-1}$<0.7)

$f_i$=2000 Hz

3. QUANTIZATION

3.1 Overview

The transmitted parameters of the 1.2 kbps coder are the same as those of the 2.4 kbps MELP coder except that in the 1.2 kbps coder the parameters are not transmitted frame by frame but are sent once for each superframe. The bit-allocation is shown in Table 1. New quantization schemes were designed to take advantage of the long block size (the superframe) by using interpolation and vector quantization (VQ). The statistical properties of voiced and unvoiced speech are also taken into account. The same Fourier magnitude codebook of the 2.4 MELP kbps coder is used in the 1.2 kbps coder in order to save memory and to make the transcoding easier.

3.2 Pitch Quantization

The pitch parameters are applicable only for voiced frames. Different pitch quantization schemes are used for different U/V combinations across the three frames. The detailed method for quantizing the pitch values of a superframe is herein described for a particular voicing pattern. The quantization method described in this section is used in the joint quantization of the voicing pattern, while the pitch will be described in the following section. The pitch quantization schemes are summarized in Table 3. Within those superframes where the voicing pattern contains either two or three voiced frames, the pitch parameters are vector-quantized. For voicing patterns containing only one voiced frame, the scalar quantizer specified in the MELP standard is applied for the pitch of the voiced frame. For the UUU voicing pattern, where each frame is unvoiced, no bits are needed for pitch information. Note that U denotes "Unvoiced" and V denotes "Voiced".

Each pitch value, P, obtained from the pitch analysis of the 2.4 kbps standard is transformed into a logarithmic value, p=log P, before quantization. For each superframe, a pitch vector is constructed with components equal to the log pitch value for each voiced frame and a zero value for each unvoiced frame. For voicing patterns with two or three voiced frames, the pitch vector is quantized using a VQ (Vector Quantization) algorithm with a new distortion measure that takes into account the evolution of the pitch. This algorithm incorporates pitch differentials in the codebook search, which makes it possible to consider the time evolution of the pitch. A standard VQ codebook design is used [7]. The VQ encoding algorithm incorporates pitch differentials in the codebook search, which makes it possible to consider the time evolution of the pitch in selecting the VQ codebook entry. This feature is motivated by the perceptual importance of adequately tracking the pitch trajectory. The algorithm has three steps for obtaining the best index:

Step 1: Select the M-best candidates using the weighted squared Euclidean distance measure:

$$d=\sum_{i=1}^{3} w_i|\hat{p}_i-\hat{p}_i|^2 \tag{1}$$

where $$w_i=\begin{cases}1, & \text{if the corresponding frame is voiced}\\ 0, & \text{if the corresponding frame is unvoiced}\end{cases}.$$

and $P_i$ is the unquantized log pitch, $\hat{p}_i$ is the quantized log pitch value. The above equation indicates that only voiced frames are taken into consideration in the codebook search.

Step 2: Calculate differentials of the unquantized log pitch values using:

$$\Delta p_i=\begin{cases}p_i-p_{i-1} & \text{if } i-th \text{ and } (i-1)-th \text{ frames are voiced}\\ 0 & \text{else}\end{cases} \tag{2}$$

for i=1, 2, 3, where $P_0$ is the last log pitch value of the previous superframe. For the candidate log pitch values selected in step 1, calculate differentials of the candidates by replacing $\Delta p_i$ and $p_i$ by $\Delta\hat{p}_i$ and $\hat{p}_i$ respectively in equation (2), where $\hat{p}_0$ is the quantized version of $p_0$.

Step 3: Select the index from the M best candidates that minimizes:

$$d'=\sum_{i=1}^{3} w_i|p_i-\hat{p}_i|^2+\delta\sum_{i=1}^{3}|\Delta p_i-\Delta\hat{p}_i|^2=d+\delta\sum_{i=1}^{3}|\Delta p_i-\Delta\hat{p}_i|^2 \tag{3}$$

where δ is a parameter to control the contribution of pitch differentials which is set to be 1.

For superframes that contain only one voiced frame, scalar quantization of the pitch is performed. The pitch value is quantized on a logarithmic scale with a 99-level uniform quantizer ranging from 20 to 160 samples. The quantizer is the same as that in the 2.4 kbps MELP standard, where the 99 levels are mapped to a 7 bit pitch codeword and the 28 unused codewords with Hamming weight 1 or 2 are used for error protection.

3.3 Joint Quantization of Pitch and U/V Decisions

The U/V decisions and pitch parameters for each superframe are jointly quantized using 12 bits. The joint quantization scheme is summarized in Table 4. In other words, the voicing pattern or mode (one of 8 possible patterns) and the set of three pitch values for the superframe form the input to a joint quantization scheme whose output is a 12 bit word. The decoder subsequently maps this 12 bit word by means of a table lookup into a particular voicing pattern and a quantized set of 3 pitch values.

In this scheme, the allocation of 12-bits consists of 3 mode bits (representing the 8 possible combinations of U/V decisions for the 3 frames in a superframe) and the remaining 9 bits for pitch values. The scheme employs six separate pitch codebooks, five having 9 bits (i.e. 512 entries each) and one being the scalar quantizer as indicated in Table 4; the specific codebook is determined according to the bit patterns of the 3-bit codeword representing the quantized voicing pattern. Therefore the U/V voicing pattern is first encoded into a 3-bit codeword as shown in Table 4, which is then used to select one of the 6 codebooks shown. The ordered set of 3 pitch values is then vector quantized with the selected codebook to generate a 9-bit codeword that identifies the quantized set of 3 pitch values. Note that four codebooks are assigned to the superframes in the VVV (voiced-voiced-voiced) mode, which means that the pitch vectors in the VVV type superframes are each quantized by one of 2048 codewords. If the number of voiced frames in the superframe is not larger than one, the 3-bit codeword is set to 000 and the distinction between different modes is determined within the 9-bit codebook. Note that the latter case consists of the 4 modes UUU, VUU, UVU, and UUV (where U denotes an unvoiced frame and V a voiced frame and the three symbols indicate the voicing status of the ordered set of 3 frames in a superframe). In this case, the 9 available bits are more than sufficient to represent the mode information as well as the pitch value since there are 3 modes with 128 pitch values and one mode with no pitch value.

3.4 Parity Bit

To improve robustness to transmission errors, a parity check bit is computed and transmitted for the three mode bits (representing voicing patterns) in the superframe as defined above in Section 3.3.

3.5 LSF Quantization

The bit allocation for quantizing the line spectral frequencies (LSF's) is shown in Table 5, with the original LSF vectors for the three frames denoted by $l_1$, $l_2$, $l_3$. For the UUU, UUV, UVU and VUU modes, the LSF vectors of unvoiced frames are quantized using a 9-bit codebook, while the LSF vector of the voiced frame is quantized with a 24 bit multistage VQ (MSVQ) quantizer based on the approach described in [8].

The LSF vectors for the other U/V patterns are encoded using the following forward-backward interpolation scheme. This scheme works as follows: The quantized LSF vector of the previous frame is denoted by $\hat{l}_p$. First the LSF's of the last frame in the current superframe, $l_3$, is directly quantized to $\hat{l}_3$ using the 9-bit codebook for unvoiced frames or the 24 bit MSVQ for voiced frames. Predicted values of $l_1$ and $l_2$ are then obtained by interpolating $\hat{l}_p$ and $\hat{l}_3$ using the following equations:

$$\tilde{l}_1(j)=\alpha_1(j)\cdot l_p(n)+[1-\alpha_1(j)]\cdot l_3(j)$$

$$\tilde{l}_2(j)=\alpha_2(j)\cdot l_p(j)+[1-\alpha_2(j)]\cdot l_3(j)\ j=1,\ldots,10 \tag{4}$$

where $\alpha_1(j)$ and $\alpha_2(j)$ are the interpolation coefficients.

The design of the MSVQ (multistage vector quantization) codebooks follows the procedure explained in [8].

The coefficients are stored in a codebook and the best coefficients are selected by minimizing the distortion measure:

$$E=\sum_{j=1}^{10} w_1(j)\left|l_1(j)-\tilde{l}_1(j)\right|^2+\sum_{j=1}^{10} w_2(j)\left|l_2(j)-\tilde{l}_2(j)\right|^2 \tag{5}$$

where the coefficients $w_i(j)$ are the same as in the 2.4 kbps MELP standard. After obtaining the best interpolation coefficients, the residual LSF vector for frames 1 and 2 are computed by:

$$r_1(j)=l_1(j)-l_1(j)$$

$$r_2(j)=l_2(j)-l_2(j)\ j=1,\ldots,10 \tag{6}$$

The 20-dimension residual vector $R=[r_1(1), r_1(2), \ldots, r_1(10), r_2(1), r_2(2), \ldots, r_2(10)]$ is then quantized using weighted multi-stage vector quantization.

3.6 Method for Designing the Interpolation Codebook

The interpolation coefficients were obtained as follows. The optimal interpolation coefficients for each superframe were computed by minimizing the weighted mean square error between $l_1$, $l_2$ and $l_{i1}$, $l_{i2}$ which can be shown to result in:

$$a_1(j)=\frac{w_1(j)\left[\hat{l}_3(j)-l_1(j)\right]\cdot\left[\hat{l}_3(j)-\hat{l}_p(j)\right]}{w_1(j)\left[\hat{l}_3(j)-\hat{l}_p(j)\right]^2} \tag{7}$$

$$a_2(j)=\frac{w_2(j)\left[\hat{l}_3(j)-l_2(j)\right]\cdot\left[\hat{l}_3(j)-\hat{l}_p(j)\right]}{w_2(j)\left[\hat{l}_3(j)-\hat{l}_p(j)\right]^2}\quad j=1,\ldots,10$$

Each entry of the training database for the codebook design employs the 40-dimension vector ($\hat{l}_p$, $l_1$, $l_2$, $l_3$), and the training procedure described below. The database is denoted as $L=\{(\hat{l}_{p,n}, l_{1,n}, l_{2,n}, l_{3,n}), n=0, 2, \ldots, N-1\}$, where $(\hat{l}_{p,n}, l_{1,n}, l_{3,n})=[\hat{l}_{p,n}(1), \ldots, \hat{l}_{p,n}(10), l_{1,n}(1), \ldots, l_{1,n}(10), l_{3,n}(1), \ldots, ml_{3,n}(10)]$ is a 40 dimension vector. The output codebook is $C=\{(\alpha_{1,m}, \alpha_{2,m}), m=0, \ldots M-1\}$, where $(\alpha_{1,m}, \alpha_{2,m})=[\alpha_{1,m}(1), \ldots, \alpha_{1,m}(10), \alpha_{2,m}(1), \ldots, \alpha_{2,m}(10)]$ is a 20-dimension vector.

3.6.1 The two main procedures of the codebook training are now described. Given the codebook $C=\{(\alpha_{1,m}, \alpha_{2,m}), m=0, \ldots M'-1\}$, each database entry $L_{n=(lp,n}, l_{1,n}, l_{2,n}, l_{3,n})$ is associated to a particular centroid. The equation below is used to compute the error finction a between the entry (input vector) and each centroid in the codebook. The entry $L_n$ is associated to the centroid which gives the smallest error. This step defines a partition on the input vectors.

$$\varepsilon_m = \sum_{j=1}^{10} w_1(j)\{l_{1,n}(j) - [a_{1,m}(j)\hat{l}_{p,n}(j) + (1 - a_{1,m}(j)\hat{l}_{3,n}(j))]\}^2 + \sum_{j=1}^{10} w_2(j)\{l_{2,n}(j) - [a_{2,m}(j)\hat{l}_{p,n}(j) + (1 - a_{2,m}(j)\hat{l}_{3,n}(j))]\}^2 \quad (8)$$

3.6.2 Given a particular partition, the codebook is updated. Assume N' database entries are associated to the centroid $A_m=(\alpha_{1,m}\alpha_{2,m})$ then the centroid is updated using the following equation:

$$a_{1,m}(j) = \frac{\sum_{n=0}^{N'-1} w_{1,n}(j)[\hat{l}_{3,n}(j) - l_{1,n}(j)] \cdot [\hat{l}_{3,n}(j) - \hat{l}_{p,n}(j)]}{\sum_{n=0}^{N'-1} w_{1,n}(j)[\hat{l}_{3,n}(j) - \hat{l}_{p,n}(j)]^2} \quad (9)$$

$$a_{2,m}(j) = \frac{\sum_{n=0}^{N'-1} w_{2,n}(j)[\hat{l}_{3,n}(j) - l_{2,n}(j)] \cdot [\hat{l}_{3,n}(j) - \hat{l}_{p,n}(j)]}{\sum_{n=0}^{N'-1} w_{2,n}(j)[\hat{l}_{3,n}(j) - \hat{l}_{p,n}(j)]^2}$$

The interpolation coefficients codebook was trained and tested for several codebook sizes. A codebook with 16 entries was found to be quite efficient. The above procedure is readily understood by engineers familiar with the general concepts of vector quantization and codebook design as described in [7].

3.7 Gain Quantization

In the 1.2 kbps coder, two gain parameters are calculated per frame, with 6 gains per superframe. The 6 gain parameters are vector-quantized using a 10 bit vector quantizer with a MSE criterion defined in the logarithmic domain.

3.8 Bandpass Voicing Quantization

The voicing information for the lowest band out of the total of 5 bands is determined from the U/V decision. The voicing decisions of the remaining 4 bands are employed only for voiced frames. The binary voicing decisions (1 for voiced and 0 for unvoiced) of the 4 bands are quantized using the 2-bit codebook shown in Table 2. This procedure results in two bits being used for voicing in each voiced frame. The bit allocation required in different coding modes for bandpass voicing quantization is shown in Table 6.

3.9 Quantization of Fourier Magnitudes

The Fourier magnitude vector is computed only for voiced frames. The quantization procedure for Fourier magnitudes is summarized in Table 7. The unquantized Fourier magnitude vectors for the three frames in a superframe are denoted as $f_i$,i=1,2,3. Denoted by $f_0$ is the Fourier magnitude vector of the last frame in the previous superframe, $\hat{f}_i$ denotes the quantized vector $f_i$, and Q(.) denotes the quantizer function for the Fourier magnitude vector when using the same 8-bit codebook as used within the MELP standard. The quantized Fourier magnitude vectors for the three frames in a superframe are obtained as shown in Table 7.

3.10 Aperiodic flag quantization

The 1.2 kbps coder uses 1-bit per superframe for the quantization of the aperiodic flag. In the 2.4 kbps MELP standard, the aperiodic flag requires one bit per frame, which is three bits per superframe. The compression to one bit per superframe is obtained using the quantization procedure shown in Table 8. In the table, "J" and "-" indicate respectively the aperiodic flag states of set and not set.

3.11 Error Protection 3.11.1 Mode protection

Aside from the parity bit, additional mode error protection techniques are applied to superframes by employing the spare bits that are available in all superframes except the superframes in the VVV mode. The 1.2 kbps coder uses two bits for the quantization of the bandpass voicing for each voiced frame. Hence, in superframes that have one unvoiced frame, two bandpass voicing bits are spare and can be used for mode protection. In superframes that have two unvoiced frames, four bits can be used for mode protection. In addition 4 bits of LSF quantization are used for mode protection in the UUU and VVU modes. Table 9 shows how these mode protection bits are used. Mode protection implies protection of the coding state, which was described in Section 1.1.

3.11.2 Forward Error Correction for UUU Superframe

In the UUU mode, the first 8 MSB's of the gain index are divided into two groups of 4 bits and each group is protected by the Hamming (8, 4) code. The remaining 2 bits of the gain index are protected with the Hamming (7, 4) code. Note that the Hamming (7, 4) code corrects single bit-errors, while the (8, 4) code corrects single bit errors and in addition detects double bit-errors. The LSF bits for each frame in the UUU superframes are protected by a cyclic redundancy check (CRC) with a CRC (13, 9) code which detects single and double bit-errors.

4. DECODER 4.1 Bit Unpacking and Error Correction

Within the decoder, the received bits are unpacked from the channel and assembled into parameter codewords. Since the decoding procedures for most parameters depend on the mode (the U/V pattern), the 12 bits allocated for pitch and U/V decisions are decoded first. For the bit pattern 000 in the 3-bit codebook, the 9-bit codeword specifies one of the UUU, UUV, UVU, and VUU modes. If the code of the 9-bit codebook is all-zeros, or has one bit set, the UUU mode is used. If the code has two bits set, or specifies an index unused for pitch, a frame erasure is indicated.

After decoding the U/V pattern, the resulting mode information is checked using the parity bit and the mode protection bits. If an error is detected, a mode correction algorithm is performed. The algorithm attempts to correct the mode error using the parity bits and mode protection bits. In the case that an uncorrectable error is detected, different decoding methods are applied for each parameter according to the mode error patterns. In addition, if a parity error is found, a parameter-smoothing flag is set. The correction procedures are described in Table 10.

In the UUU mode, assuming no errors were detected in the mode information, the two (8, 4) Hamming codes representing the gain parameters are decoded to correct single bit errors and detect double errors. If an uncorrectable error is detected, a frame erasure is indicated. Otherwise the (7, 4) Hamming code for gain and the (13, 9) CRC (cyclic redundancy check) codes for LSF's are decoded to correct single errors and detect single and double errors, respectively. If an error is found in the CRC (13, 9) codes, the incorrect LSF's are replaced by repeating previous LSF's or interpolating between the neighboring correct LSF's.

If a frame erasure is detected in the current superframe by the Hamming decoder, or an erasure is directly signaled from the channel, a frame repeat mechanism is implemented. All the parameters of the current superframe are replaced with the parameters from the last frame of the previous superframe.

For a superframe in which an erasure is not detected, the remaining parameters are decoded. If smoothing is necessary, the post-smoothing parameter is obtained by:

$$x=0.5\hat{x}+0.5x' \tag{10}$$

where $\hat{x}$ and x' represent the decoded parameter of the current frame and the corresponding parameter of the previous frame, respectively.

4.2 Pitch Decoding

The pitch decoding is performed as shown in Table 4. For unvoiced frames, the pitch value is set to 50 samples.

4.3 LSF Decoding

The LSF's are decoded as described in Section 4.4 and Table 5. The LSF's are checked for ascending order and minimum separation.

4.4 Gain decoding

The gain index is used to retrieve a codeword containing six gain parameters from the 10-bit VQ gain codebook.

4.5 Decoding of Bandpass Voicing

In the unvoiced frames, all of the bandpass voicing strengths are set to zero. In the voiced frames, $Vbp_l$ is set to 1 and the remaining voicing patterns are decoded as shown in Table 2.

4.6 Decoding of Fourier Magnitudes

The Fourier magnitudes of unvoiced frames are set equal to 1. For the last voiced frame of the current superframe, the Fourier magnitudes are decoded directly. The Fourier magnitudes of other voiced frames are generated by repetition or linear interpolation as shown in Table 7.

4.7 Aperiodic Flag Decoding

The aperiodic flags are obtained from the new flag as shown in Table 8. The jitter is set to 25% if the aperiodic flag is 1, otherwise the jitter is set to 0%.

4.8 MELP Synthesis

The basic structure of the decoder is the same as in the MELP standard except that a new harmonic synthesis method is introduced to generate the excitation signal for each pitch cycle. In the original 2.4 kbps MELP algorithm, the mixed excitation is generated as the sum of the filtered pulse and noise excitations. The pulse excitation is computed using an inverse discrete Fourier transform (IDFT) of one pitch period in length and the noise excitation is generated in the time domain. In the new harmonic synthesis algorithm, the mixed excitation is generated completely in the frequency domain and then an inverse discrete Fourier transform operation is performed to convert it into the time domain. This avoids the need for bandpass filtering of the pulse and noise excitations, thereby reducing complexity of the decoder.

In the new harmonic synthesis procedure, the excitation in the frequency domain is generated for each pitch cycle based on the cutoff frequency and the Fourier magnitude vector $A_l$, l=1, 2, . . . , L. The cutoff frequency is obtained from the bandpass voicing parameters as previously described and it is then interpolated for each pitch cycle. The Fourier magnitudes are interpolated in the same way as in the MELP standard.

With the pitch length denoted as N, the corresponding fuidamental frequency is described by: $f_0=2\pi/N$. The Fourier magnitude vector length is then given by: L=N/2. Two transition frequencies $F_H$ and $F_L$ are determined from the cutoff frequency F employing an empirically derived algorithm. algorithm as follows, $$F_H=\begin{cases}0.85F & 0\text{Hz}\le F\le 500\text{Hz}\\ 0.95F & 500\text{Hz}\le F\le 1000\text{Hz}\\ 0.98F & 1000\text{Hz}\le F\le 2000\text{Hz}\\ 0.95F & 2000\text{Hz}\le F\le 3000\text{Hz}\\ 0.92F & 3000\text{Hz}\le F\le 4000\text{Hz}\end{cases}$$

$$F_L=\begin{cases}1.05F & 0\text{Hz}\le F\le 500\text{Hz}\\ 1.05F & 500\text{Hz}\le F\le 1000\text{Hz}\\ 1.02F & 1000\text{Hz}\le F\le 2000\text{Hz}\\ 1.05F & 2000\text{Hz}\le F\le 3000\text{Hz}\\ 1.00F & 3000\text{Hz}\le F\le 4000\text{Hz}\end{cases}$$

These transition frequencies are equivalent to two frequency component indices $V_H$ and $V_L$. A voiced model is used for all the frequency samples below $V_L$, a mixed model is used for frequency samples between $V_L$ and $V_H$, and an unvoiced model is used for frequency samples above $V_H$. To define the mixed mode, a gain factor g is selected with the value depending on the cutoff frequency (the higher the cutoff frequency F, the smaller the gain factor).

$$g=\begin{cases}1.0 & 0\text{Hz}\le F\le 500\text{Hz}\\ 0.9 & 500\text{Hz}\le F\le 1000\text{Hz}\\ 0.8 & 1000\text{Hz}\le F\le 2000\text{Hz}\\ 0.75 & 2000\text{Hz}\le F\le 3000\text{Hz}\\ 0.7 & 3000\text{Hz}\le F\le 4000\text{Hz}\end{cases}$$

The magnitude and phase of the frequency components of the excitation are determined as follows:

$$|X(l)|=\begin{cases}A_l & l<V_L\\ \dfrac{l-V_l}{V_H-V_L}\cdot g\cdot A_l+\dfrac{V_H-1}{V_H-V_L}\cdot A_l & V_L\le l\le V_H\\ g\cdot A_l & l>V_H\end{cases} \tag{11}$$

$$\angle X(l)=\begin{cases}l\phi_0 & l<V_L\\ l\phi_0-\dfrac{l-V_L}{V_H-V_L}\cdot\phi_{RND}(l) & V_L\le l\le V_H\\ \phi_{RND}(l) & l>V_H\end{cases} \tag{12}$$

where l is an index identifying a particular frequency component of the IDFT frequency range and $\phi_0$ is a constant selected so as to avoid a pitch pulse at the pitch cycle boundary. The phase $\phi_{RND}(l)$ is a uniformly distributed random number between $-2\pi$ and $2\pi$ independently generated for each value of l.

In other words, the spectrum of the mixed excitation signal in each pitch period is modeled by considering three regions of the spectrum, as determined by the cutoff frequency, which determines a transition interval from $F_L$ to $F_H$. In the low region, from 0 to $F_L$, the Fourier magnitudes directly determine the spectrum. In the high region, above $F_H$, the Fourier magnitudes are scaled down by the gain factor g. In the transition region, from $F_L$ to $F_H$, the Fourier magnitudes are scaled by a linearly decreasing weighting factor that drops from unity to g across the transition region. A linearly increasing phase is used for the low region, and random phases are used for the high region. In the transition region, the phase is the sum of the linear phase and a weighted random phase with the weight increasing linearly from 0 to 1 across the transition region. The frequency samples of the mixed excitation are then converted to the time domain using an inverse Discrete Fourier Transform.

5. TRANSCODER 5.1 Concepts

In some applications, it is important to allow interoperation between two different speech coding schemes. In particular, it is useful to allow interoperability between a 2400 bps MELP coder and a 1200 bps superframe coder. The general operation of a transcoder is illustrated in the block diagrams of FIGS. 5A and 5B. In the up-converting transcoder 70 of FIG. 5A, speech is input 72 to a 1200 bps vocoder 74 whose output is an encoded bit stream at 1200 bps 76 which is converted by the "Up-Transcoder" 78 into a 2400 bps bit stream 80 in a form allowing it to be decoded by a 2400 bps MELP decoder 82, that outputs synthesized speech 84. Conversely, in the down-converting transcoder 90 of FIG. 3B speech is input 92 to a 2400 bps MELP encoder 94, which outputs a 2400 bps bit stream 96 into a "Down-Transcoder" 98, that converts the parametric data stream into a 1200 bps bit stream 100 that can be decoded by the 1200 bps decoder 102, that outputs synthesized speech 104. In full-duplex (two-way) voice communication both the up-transcoder and the down-transcoder are needed to provide interoperability.

A simple way to implement an up-transcoder is to decode the 1200 bps bit stream with a 1200 bps decoder to obtain a raw digital representation of the recovered speech signal which is then re-encoded with a 2400 bps encoder. Similarly, a simple method for implementing a down-transcoder is to decode the 2400 bps bit stream with a 2400 bps decoder to obtain a raw digital representation of the recovered speech signal which is then re-encoded with a 1200 bps encoder. This approach to implementing up and down transcoders, corresponds to what is called "tandem" encoding and has the disadvantages that the voice quality is substantially degraded and the complexity of the transcoder is unnecessarily high. Transcoder efficiency is improved with the following method for transcoding that reduces complexity while avoiding much of the quality degradation associated with tandem encoding.

5.2 Down-Transcoder

In the down-transcoder, after synchronization and channel error correction decoding are performed, the bits representing each parameter are separately extracted from the bit stream for each of three consecutive frames (constituting a superframe) and the set of parameter information is stored in a parameter buffer. Each parameter set consists of the values of a given parameter for the three consecutive frames. The same methods used to quantize superframe parameters are applied here to each parameter set for recoding into the lower-rate bit stream. For example, the pitch and U/V decision for each of 3 frames in a superframe is applied to the pitch and U/V quantization scheme described in Section 3.2. In this case, the parameter set consists of 3 pitch values each represented with 7 bits and 3 U/V decisions each given by 1 bit, giving a total of 24 bits. This is extracted from the 2400 bps bit stream and the recoding operation converts this into 12 bits to represent the pitch and voicing for the superframe. In this way, the down-transcoder does not have to perform the MELP analysis functions and only performs the needed quantization operations for the superframe. Note that the parity check bit, synchronization bit, and error correction bits must be regenerated as part of the down transcoding operation.

5.3 Up-Transcoder

In the case of an up-transcoder the input bit stream of 1200 bps contains quantized parameters for each superframe. After synchronization and error correction decoding are performed, the up-transcoder extracts the bits representing each parameter for the superframe which are mapped (recoded) into a larger number of bits that specify separately the corresponding values of that parameter for each of the three frames in the current superframe. The method of performing this mapping, which is parameter dependent, is described below. Once all parameters for a frame of the superframe have been determined, the sequence of bits representing three frames of speech are generated. From this data sequence, the 2400 bps bit stream is generated, after insertion of the synchronization bit, parity bit, and error correction encoding.

The following is a description of the general approach to mapping (decoding) the parameter bits for a superframe into separate parameter bits for each of the three frames. Quantization tables and codebooks are used in the 1200 bps decoder for each parameter as described previously. The decoding operation takes a binary word that represents one or more parameters and outputs a value for each parameter, e.g. a particular LSF value or pitch value as stored in a codebook. The parameter values are requantized, i.e. applied as input to a new quantizing operation employing the quantization tables of the 2400 bps MELP coder. This requantization leads to a new binary word that represents the parameter values in a form suitable for decoding by the 2400 bps MELP decoder.

As an example to illustrate the use of requantization, from the 1200 bps bit stream, the bits containing the pitch and voicing information for a particular superframe are extracted and decoded into 3 voicing (V/U) decisions and 3 pitch values for the 3 frames in the superframe; The 3 voicing decisions are binary and are directly usable as the voicing bits for the 2400 bps MELP bitstream (one bit for each of 3 frames). The 3 pitch values are requantized by applying each to the MELP pitch scalar quantizer obtaining a 7 bit word for each pitch value. Numerous alternative implementation of pitch requantization which follow the inventive method described can be designed by a person skilled in the art.

One specific alteration can be created by bypassing pitch requantization when only a single frame of the superframe is voiced, since in this case the pitch value for the voiced frame is already specified in quantized form consistent with the format of the MELP vocoder. Similarly, for the Fourier magnitudes, requantization is not needed for the last frame of a superframe since it is has already been scalar quantized in the MELP format. However the interpolated Fourier magnitudes for the other two frames of the superframe need to be requantized by the MELP quantization scheme. The jitter, or aperiodic flag, is simply obtained by table lookup using the last two columns of Table 8.

6. DIGITAL VOCODER TERMINAL HARDWARE

Figure 6:
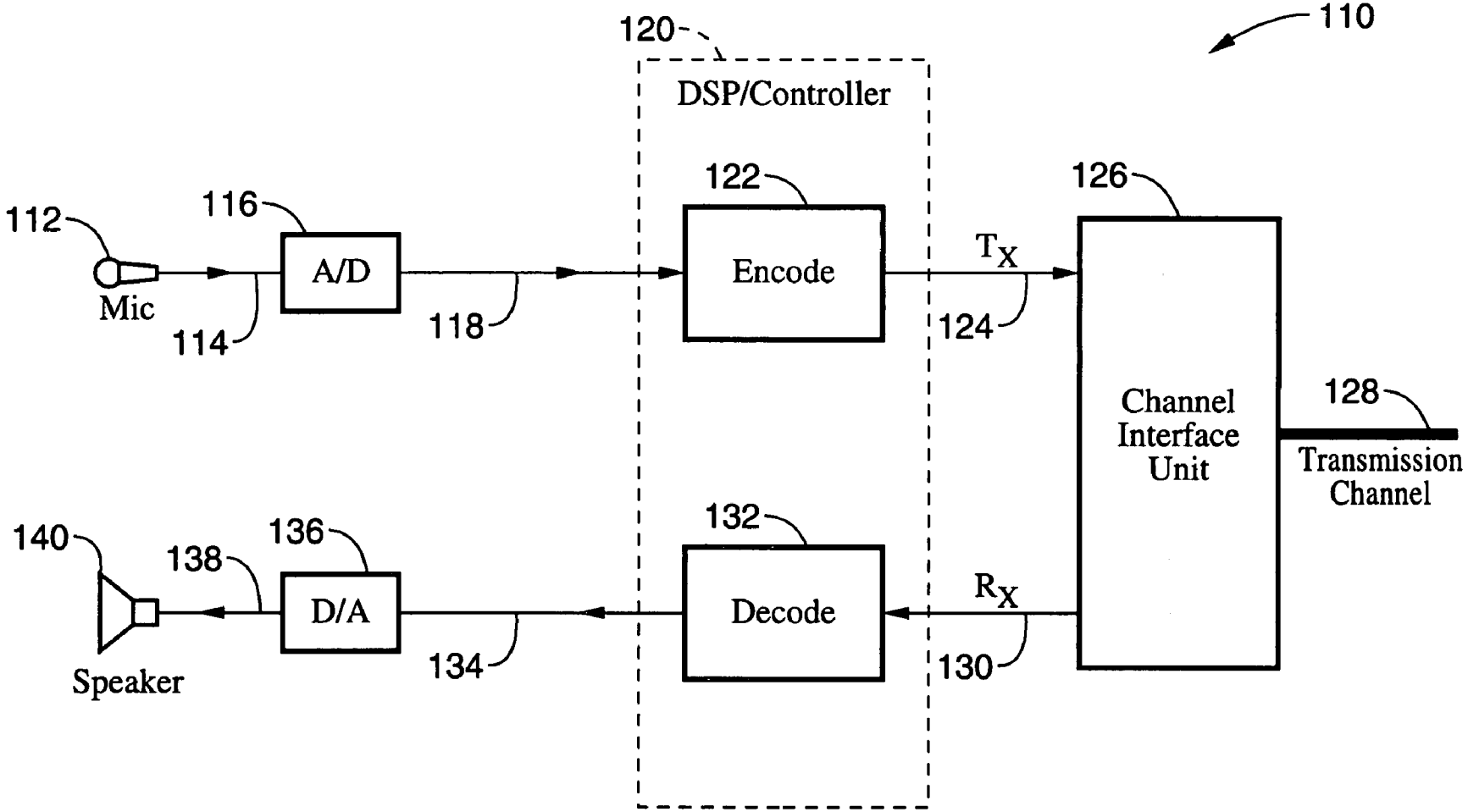
FIG. 6 is a functional block diagram of hardware within a digital vocoder terminal which employs the inventive principles in accord with the present invention.

FIG. 6 shows a digital vocoder terminal containing an encoder and decoder that operate in accordance with the voice coding methods and apparatus of this invention. The microphone MIC 112 is an input speech transducer providing an analog output signal 114 which is sampled and digitized by an Analog to Digital Converter (A/D) 116. The resulting sampled and digitized speech 118 is digitally processed and compressed within a DSP/controller chip 120, by the voice encoding operations performed in the Encode block 122, which is implemented in software within the DSP/Controller according to the invention.

The digital signal processor (DSP) 120 is exemplified by the Texas Instruments TMC320C5416 integrated circuit, which contains random access memory (RAM) providing sufficient buffer space for storing speech data and intermediate data and parameters; the DSP circuit also contains read-only memory (ROM) for containing the program instructions, as previously described, to implement the vocoder operations. A DSP is well suited for performing the vocoder operations described in this invention. The resultant bitstream from the encoding operation 124 is a low rate bit-stream, Tx data stream. The Tx data 124 enters a Channel Interface Unit 126 to be transmitted over a channel 128.

On the receiving side, data from a channel 128 enters a Channel Interface Unit 126 which outputs an Rx bit-stream 130. The Rx data 130 is applied to a set of voice decoding operations within the decode block; the operations have been previously described. The resulting sampled and digitized speech 134, is applied to a Digital to Analog Converter (D/A) 136. The D/A outputs reconstructed analog speech 138. The reconstructed analog speech 138 is applied to a speaker 140, or other audio transducer which reproduces the reconstructed sound.

FIG. 6 is a representation of one configuration of hardware on which the inventive principles may be practiced. The inventive principles may be practiced on various forms of vocoder implementations that can support the processing functions described herein for the encoding and decoding of the speech data. Specifically the following are but a few of the many variations included within the scope of the inventive implementation:

(a) Using Channel Interface Units which contain a voiceband data modem for use when the transmission path is a conventional telephone line.

(b) Using encrypted digital signals for transmission and described for reception via a suitable encryption device to provide secure transmission. In this case, the encryption unit would also be contained in the Channel Interface Unit.

(c) Using a Channel Interface Unit that contains a radio frequency modulator and demodulator for wireless signal transmission by radio waves for cases in which the transmission channel is a wireless radio link.

(d) Using a Channel Interface Unit that contains multiplexing and demultiplexing equipment for sharing a common transmission channel with multiple voice and/or data channels. In this case multiple Tx and Rx signals would be connected to the Channel Interface Unit.

(e) Employing discrete components, or a mix of discrete elements and processing elements, to replace the instruction processing operations of the DSP/Controller. Examples that could be employed include programmable gate arrays (PGAs). It must be noted that the invention can be fully reduced to practice in hardware, without the need of a processing element.

Hardware to support the inventive principles need only support the data operations described. However, use of a DSP/processor chips are the most common circuits used for implementing speech coders or vocoders in the current state of the art.

Although the description above contains many specificities, these should not be construed as limiting the scope of the invention but as merely providing illustrations of some of the presently preferred embodiments of this invention. Thus the scope of this invention should be determined by the appended claims and their legal equivalents.

TABLE 1

Bit Allocation of both 2.4 kbps and 1.2 kbps Coding Schemes

| | Bits for quantization of three frames(540 samples) | | | | | | |
|---|---|---|---|---|---|---|---|
| Parameters | 2.4 kbps Voiced | 2.4 kbps Unvoiced | 1.2 kbps state 1 | 1.2 kb state 2 | 1.2 kb state 3 | 1.2 kb state 4 | 1.2 kbps state 5 |
| Pitch & Global UV Decisions | 7 * 3 | 7 * 3 | 12 | 12 | 12 | 12 | 12 |
| Parity | 0 | 0 | 1 | 1 | 1 | 1 | 1 |
| LSF's | 25 * 3 | 25 * 3 | 42 | 42 | 39 | 42 | 27 |
| Gains | 8 * 3 | 8 * 3 | 10 | 10 | 10 | 10 | 10 |
| Bandpass Voicing | 4 * 3 | 0 | 6 | 4 | 4 | 2 | 0 |
| Fourier Magnitudes | 8 * 3 | 0 | 8 | 8 | 8 | 8 | 0 |
| Jitter | 1 * 3 | 0 | 1 | 1 | 1 | 1 | 0 |
| Synchronization | 1 * 3 | 1 * 3 | 1 | 1 | 1 | 1 | 1 |
| Error Protection | 0 | 13 * 3 | 0 | 2 | 5 | 4 | 30 |
| Total | 162 | 162 | 81 | 81 | 81 | 81 | 81 |

*Note:

1.2 kbps State 1: All three frames are voiced.

1.2 kbps State 2: One of the first two frames is unvoiced, other frames are voiced.

1.2 kbps State 3: The 1st and 2nd frames are voiced. The 3rd frame is unvoiced.

1.2 kbps State 4: One of the three frames is voiced, other two frames are unvoiced.

1.2 kbps State 5: All three frames are unvoiced.

TABLE 2

Bandpass voicing index mapping

| Codeword: | 0000 | 1000 | 1100 | 1111 |
|---|---|---|---|---|
| Voicing patterns assigned to the codeword. | 0000<br>0001<br>0010<br>0011<br>0100<br>0101<br>0110 | 1000<br>1001<br>1010 | 1100 | 0111<br>1011<br>1101<br>1110<br>1111 |
| Cutoff Frequency | 500 Hz | 1000 Hz | 2000 Hz | 4000 Hz |

TABLE 3

Pitch quantization schemes

| U/V pattern | Pitch quantization method |
|---|---|
| U U U | N/A |
| U U V<br>U V U<br>V U U | The pitch of the only voiced frame is scalar quantized using a 7-bit quantizer. |
| U V V<br>V U V<br>V V U | The pitches of the voiced frames are quantized using the same VQ as for the VVV case. A weighting function is applied which takes into account the U/V information. |
| V V V | Vector quantization of three pitches |

TABLE 4

Joint quantization scheme of pitch and voicing decisions

| U/V patterns | 3-bit codewords | 9-bit codebooks |
|---|---|---|
| UUU<br>UUV<br>UVU<br>VUU | 000 | The pitch value is quantized with the same 99-level uniform quantizer as in the 2.4 kbps standard. The pitch value and U/V pattern are then mapped to a codevector in this 9-bit codebook. |
| VVU<br>VUV<br>UVV<br>VVV | 001<br>010<br>100<br>011 | These U/V patterns share the same codebook containing 512 codevectors of the pitch triple.<br>512-entry codebook A |
| | 101 | 512-entry codebook B |
| | 110 | 512-entry codebook C |
| | 111 | 512-entry codebook D |

TABLE 5

Bit allocation for LSF quantization according to UV decisions

| U/V pattern | LSF $l_1$ | LSF $l_2$ | LSF $l_3$ | Interpolation | Residual of $l_1$ and $l_2$ | Total |
|---|---|---|---|---|---|---|
| U U U | 9 | 9 | 9 | 0 | 0 | 27 |
| V U U | 8 + 6 + 5 + 5 | 9 | 9 | 0 | 0 | 42 |
| U V U | 9 | 8 + 6 + 5 + 5 | 9 | 0 | 0 | 42 |
| U U V | 9 | 9 | 8 + 6 + 5 + 5 | 0 | 0 | 42 |
| U V V | 0 | 0 | 8 + 6 + 5 + 5 | 4 | 8 + 6 | 42 |
| V U V<br>V V V<br>V V U | 0 | 0 | 9 | 4 | 8 + 6 + 6 + 6 | 39 |

TABLE 6

Bit Allocation for bandpass voicing quantization

| UV decisions pattern | VVV | VVU, VUV, UVV | VUU, UVU, UUV | UUU |
|---|---|---|---|---|
| Bits for bandpass voicing information | 6 | 4 | 2 | 0 |

TABLE 7

Fourier magnitude vector quantization

| U/V pattern for current superframe | U/V decision for the last frame of the previous superframe: U | V |
|---|---|---|
| UUU | N/A | |
| VUU | $\hat{f}_1 = Q(f_1)$ | |
| UVU | $\hat{f}_2 = Q(f_2)$ | |
| UUV | $\hat{f}_3 = Q(f_3)$ | |
| UVV | $\hat{f}_3 = Q(f_3)$, $\hat{f}_2 = \hat{f}_3$ | |
| VUV | $\hat{f}_3 = Q(f_3)$, $\hat{f}_1 = \hat{f}_3$ | $\hat{f}_3 = Q(f_3)$, $\hat{f}_1 = \hat{f}_0$ |
| VVU | $\hat{f}_2 = Q(f_2)$, $\hat{f}_1 = \hat{f}_2$ | $\hat{f}_2 = Q(f_2)$, $\hat{f}_1 = \frac{\hat{f}_0 + \hat{f}_2}{2}$ |
| VVV | $\hat{f}_2 = Q(f_2)$, $\hat{f}_1 = \hat{f}_2 = \hat{f}_3$ | $\hat{f}_3 = Q(f_3)$, $\hat{f}_1 = \frac{2 \cdot \hat{f}_0 + \hat{f}_3}{3}$, $\hat{f}_2 = \frac{\hat{f}_0 + 2 \cdot \hat{f}_3}{3}$ |

TABLE 8

Aperiodic flag quantization using 1 bit

| U/V pattern | Quantization Procedure | Quantization Patterns: New flag = 0 | Quantization Patterns: New flag = 1 |
|---|---|---|---|
| U U U | N/A | J J J | J J J |
| U U V | If the voiced frame has | J J - | J J J |
| U V U | aperiodic flag, set new | J - J | J J J |
| V U U | flag. | - J J | J J J |
| U V V | If the second frame has | J - - | J J - |
| V V U | aperiodic flag, set new flag. | - - J | - J J |
| V U V | N/A | - J - | - J - |
| V V V | If >1 frame has the aperiodic flag set, set new flag. | - - - | J J J |

TABLE 9

Mode protection schemes

| U/V pattern | 3-b codebook of joint quantization for pitch and U/V decisions | Bit pattern of bandpass voicing 1 | Bit pattern of bandpass voicing 2 | Bit pattern of LSF |
|---|---|---|---|---|
| U U U | 000 | 00 | 00 | 0000 |
| U U V | | 00 | 01 | — |
| U V U | | 00 | 10 | — |
| V U U | | 00 | 11 | — |
| V V U | 001 | 01 | — | 0101 |
| V U V | 010 | 10 | — | — |
| U V V | 100 | 11 | — | — |
| V V V | 011, 101, 110, 111 | — | — | — |

TABLE 10

Parameter decoding schemes if a mode error is detected

| U/V pattern | Corrected U/V pattern | LSF's | Gain | Pitch | Bandpass voicing | Fourier Magnitude |
|---|---|---|---|---|---|---|
| UUU UUV UVU VUU | UUU | Repeat LSF's of the last frame in the previous superframe | Decode and apply smoothing | | Set to 0 | Set to 1 all magnitudes |
| VVU VUV VVU | VVV | Decode and apply smoothing | Decode and apply smoothing | Decode and apply smoothing | Set the first band to 1, others to 0 | |

What is claimed is:

1. A voice compression apparatus, comprising:

(a) a superframe buffer for receiving multiple frames of voice data;

(b) a frame-based encoder analysis module for analyzing characteristics of voice data within frames contained in the superframe to produce an associated set of voice data parameters; and (c) a superframe encoder for receiving voice data parameters from the analysis module for a group of frames contained within the superframe buffer, for reducing by analysis data for the group of frames and for quantizing and encoding said data into an outgoing digital bit stream for transmission, wherein said superframe encoder includes a bandpass voicing smoother for mapping multiband voicing decisions for each frame into a single cutoff frequency for that frame, wherein said cutoff frequency takes on one value from a predetermined list of allowable values.

2. A voice compression apparatus as recited in claim 1, wherein the analysis module is selected from the group of voice encoders consisting of linear predictive coders, mixed-excitation linear prediction coders, harmonic coders, and multi-band excitation coders.

3. A voice compression apparatus as recited in claim 1, wherein said superframe encoder includes at least two parametric processing modules selected from the group of parametric processing modules consisting of pitch smoothers, bandpass voicing smoothers, linear predictive quantizers, jitter quantizers, and Fourier magnitude quantizers.

4. A voice compression apparatus as recited in claim 1, wherein said superframe encoder includes a vector quantizer wherein pitch values within a superframe are vector quantized with a distortion measure responsive to pitch errors.

5. A voice compression apparatus as recited in claim 1, wherein said superfrane encoder includes a vector quantizer wherein pitch values within a superframe are vector quantized with a distortion measure responsive to pitch differentials as well as pitch errors.

6. A voice compression apparatus as recited in claim 1, wherein said super-frame encoder includes a quantizer of linear prediction parameters, wherein quantization is performed with a codebook-based interpolation of linear prediction parameters that employ different interpolation coefficients for each linear prediction parameter, and wherein said quantizer operates in closed loop mode to minimize overall error over a number of frames.

7. A voice compression apparatus as recited in claim 6, wherein said quantizer is capable of performing a line spectral frequency (LSF) quantization using said codebook-based interpolation.

8. A voice compression apparatus as recited in claim 7, wherein said codebook is created by means of a training database operated on by a centroid-based training procedure.

9. A voice compression apparatus as recited in claim 1, wherein said superframe encoder includes a pitch smoother wherein calculations are based on an onset/offset classifier.

10. A voice compression apparatus as recited in claim 1, wherein said superframe encoder includes a pitch smoother wherein pitch trajectory is calculated using a plurality of voicing decisions.

11. A voice compression apparatus as recited in claim 10, wherein said pitch smoother classifies frames into onset and offset frames based on at least four waveform feature parameters selected from the group of waveform feature parameters consisting of energy zerocrossing rate, peakiness, maximum correlation coefficient of input speech, maximum correlation coefficient of 500 Hz low pass filtered speech, energy of low pass filtered speech, and energy of high pass filtered speech.

12. A voice compression apparatus as recited in claim 1, wherein said bandpass voicing smoother performs smoothing by modifying the cutoff frequency of a frame as a function of the cutoff frequencies of neighboring frames and the average frame energy.

13. A voice compression apparatus as recited in claim 1, further comprising means for compressing aperiodic flag bits for each frame in a superframe into a single bit per superframe, which bit is created based on the distribution of voiced and unvoiced frames within the superframe.

14. A voice compression apparatus as recited in claim 1, wherein said superframe encoder includes a plurality of quantizers for encoding parametric data into a set of bits, wherein at least one of said quantizers employs vector quantization to represent interpolation coefficients.

15. A voice compression apparatus as recited in claim 1, wherein a superframe is categorized into one of a plurality of coding states based on the combination of voiced and unvoiced frames within the superframe, and wherein each of said coding states is associated with a different bit allocation to be used with the superframe.

16. A voice compression apparatus, comprising:

(a) a superframe buffer for receiving multiple frames of voice data;

(b) a frame-based analysis module for determining a set of voice data parameters for said voice data; and (c) a super-frame encoder for receiving a unquantized voice data parameters for groups of frames within a superframe, said superframe encoder comprising:

(i) a pitch smoother for determining pitch and U/V decisions for each frame of the superframe and for extracting parameters needed for frame classification into onset and offset frames, (ii) a bandpass voicing smoother for determining bandpass voicing strengths for the frames within the superframe and for determining cutoff frequencies for each frame, and (iii) a parameter quantizer and encoder for quantizing and encoding voicing parameters received from said analysis module, said pitch smoother, and said bandpass voicing smoother into a set of bits and encoding said bits into an outgoing digital bitstream for transmission.

17. A method of decoding a parametric voice encoded data stream into an audio voice signal comprising the steps of:

(a) buffering a received parametric voice data stream having a plurality of pitch periods;

(b) constructing an estimated spectrum of excitation within each pitch period by breaking down the frequency spectrum into regions based on a cutoff frequency, wherein said construction comprises the steps of:

(i) computing a Fourier magnitude for each region, wherein the resultant computed Fourier magnitude for at least one of said regions is then scaled by a gain factor computed for that region, (ii) computing phase within each region, wherein the resultant phase for at least one of said regions has been modified by use of a weighted random phase, and (iii) converting said Fourier magnitude and said phase within each region to a time domain representation by the computation of an inverse discrete Fourier transform; and (c) generating an analog voice signal from said time domain representation; wherein said regions into which the frequency spectrum is broken down comprise:

a lower region wherein Fourier magnitudes directly determine the spectrum;

a transition region wherein Fourier magnitudes are scaled down by a linearly decreasing weighting factor that drops from unity to a nonzero positive value dependent on the cutoff frequency of the current frame: and an upper region wherein Fourier magnitudes are scaled down by a weighting factor depending on the cutoff frequency of the current frame.

18. A vocoder method for encoding digitized voice into parametric voice data, comprising the steps of:

(a) loading multiple frames of digitized voice into a superframe buffer;

(b) encoding digitized voice within each frame of the superframe buffer by parametric analysis to produce frame-based parametric voice data;

(c) classifying frames as onset frames and offset frames by calculating pitch and U/V parameters within each frame of the superframe;

(d) determining a cutoff frequency for each frame within the superframe by calculating a bandpass voicing strength parameter for the frames within the superframe buffer;

(e) collecting a set of superframe parameters from the parametric analysis, frame classification, and cutoff frequency determination steps for the group of frames within the superframe;

(f) quantizing the superframe parameters into discrete values represented by a reduced set of data bits that form quantized superframe parameter data; and (g) encoding quantized superframe parameter data into a data stream of superframe-based parametric voice data that contains substantially equivalent voice information to the frame-based parametric voice data, yet at a lower bit per second rate of encoded voice.

19. A method of encoding an audio voice signal comprising:

receiving a superframe comprised of a plurality of frames of voice data corresponding to the audio voice signal;

determining for each frame in the superframe a set of unquantized voice data parameters;

determining pitch and U/V decisions for each frame in the superframe, and extracting parameters for frame classification from each frame in the superframe;

determining bandpass voicing strengths and cutoff frequencies for the frames within the superframe; and quantizing the voice data parameters, pitch, U/V decision, frame classification, bandpass voicing strengths and cutoff frequencies into a set of bits and encoding the set of bits.

20. A computer-readable medium having thereon computer-readable instructions for performing a method of encoding an audio voice signal comprising the steps of:

receiving a superframe comprised of a plurality of frames of voice data corresponding to the audio voice signal;

determining for each frame in the superframe a set of unquantized voice data parameters;

determining pitch and U/V decisions for each frame in the superframe, and extracting parameters for frame classification from each frame in the superframe;

determining bandpass voicing strengths and cutoff frequencies for the frames within the superframe; and quantizing the voice data parameters, pitch, U/V decision, frame classification, bandpass voicing strengths and cutoff frequencies into a set of bits and encoding the set of bits.

* * * * *